US005310249A

United States Patent [19]

Sugden et al.

[11] Patent Number: 5,310,249

[45] Date of Patent: May 10, 1994

[54] METHOD AND APPARATUS FOR AUTOMATICALLY CONTROLLING A MINING MACHINE

[75] Inventors: David B. Sugden, Tasmania, Australia; John Turner, Renton, Wash.; Robert J. Boyd, Queensland, Australia; Thomas M. Hartman, Des Moines, Wash.; Gerald L. Dollinger, Bellevue, Wash.; John G. Moore, Puyallup, Wash.

[73] Assignee: Z C Mines PTY LTD, Australia

[21] Appl. No.: 27,828

[22] Filed: Mar. 8, 1993

Related U.S. Application Data

[62] Division of Ser. No. 701,503, May 16, 1991, Pat. No. 5,205,612.

[30] Foreign Application Priority Data

May 17, 1990 [AU] Australia ..... PK0197

[51] Int. Cl.[5] ..... E21C 35/24; E21D 9/10

[52] U.S. Cl. ..... 299/1.3; 299/1.4; 175/27

[58] Field of Search ..... 299/1.05, 1.1, 1.2, 299/1.3, 1.4, 10, 30, 31, 73; 175/24, 27; 173/4, 5, 6, 7

[56] References Cited

U.S. PATENT DOCUMENTS

| | | | |
|---|---|---|---|
| 3,282,367 | 11/1966 | Mathew et al. | 180/235 |
| 3,439,937 | 4/1969 | Dixon | 280/446 |
| 3,662,848 | 5/1972 | Magnusson | 180/235 |
| 3,929,378 | 12/1975 | Frenyo et al. | 299/64 |
| 4,035,024 | 7/1977 | Fink | 299/31 |
| 4,079,795 | 3/1978 | Sackmann et al. | 175/27 X |
| 4,312,541 | 1/1982 | Spurgeon | 299/31 |
| 4,548,442 | 10/1985 | Sugden et al. | 299/10 |
| 4,591,209 | 5/1986 | Droscher et al. | 299/1.4 |
| 4,966,242 | 10/1990 | Baillargeon | 180/9.46 X |
| 5,035,071 | 7/1991 | Stutzer et al. | 37/94 |
| 5,113,958 | 5/1992 | Holden | 280/442 X |

FOREIGN PATENT DOCUMENTS 1265312 10/1986 U.S.S.R. ..... 299/1.2

OTHER PUBLICATIONS

Handbook of Mining and Tunnelling Machinery by Barbara Stack (1982, pp. 275-277, relating to Krupp Tunneling Machine Model KTF340.

Continuous Surface Mining, from the Proceedings of International Symposium Edmonton Sep. 29-Oct. 1, 1986, Trans Tech Publications, 1987, pp. 211 and 213, relating to the Krupp SchRs 650/5/28 BWE Excavator and 700 I BWE Excavator.

*Primary Examiner*—David J. Bagnell

*Attorney, Agent, or Firm*—Graybeal Jackson Haley & Johnson

[57] ABSTRACT

Mining apparatus is disclosed in which a cutting wheel supporting a plurality of roller-cutters rotates about a horizontal axis and is supported on a slewing boom for cutting a tunnel with a flat floor and roof and elliptical walls as it slews across a mining face. The slewing boom is supported on a main beam assembly, the front end of which rests on powered crawler tracks and the rear end of which passes through a gripper assembly which may be clamped between the floor and roof of the tunnel, and against which the main beam assembly may be urged forward for engaging the roller-cutters with the mining face. A preload crawler is urged against the roof of the tunnel above the powered crawler tracks to locate the main beam assembly rigidly relative to the tunnel such that the roller-cutters may cut the rock in the mining face with minimal loss of cutting force due to vibration. Apparatus for automatically controlling one or more of cutter penetration depth, cutter penetration rate and cutter slew rate, which includes a sensor for sensing a given mining machine parameter, a processor for processing the given mining machine parameter to provide one or more of an optimum cutter penetration depth, cutter penetration rate or cutter slew rate value, and a controller for controlling one or more of cutter penetration depth, cutter penetration rate and cutter slew rate based on the derived optimum value.

21 Claims, 31 Drawing Sheets

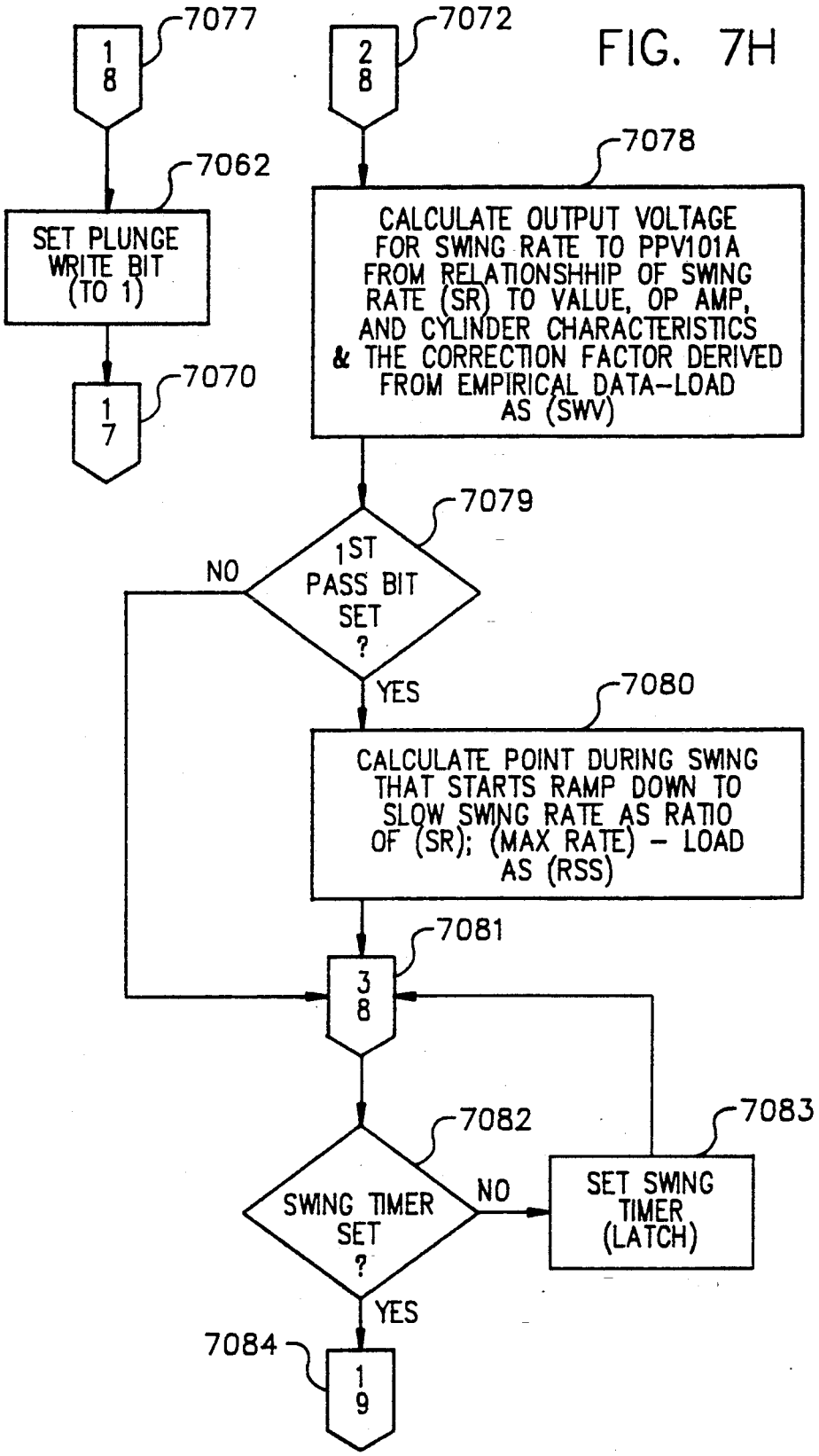
FIG. 7H
7077
1
8
7062
SET PLUNGE WRITE BIT (TO 1)
7070
1
7
7072
2
8
7078
CALCULATE OUTPUT VOLTAGE FOR SWING RATE TO PPV101A FROM RELATIONSHHIP OF SWING RATE (SR) TO VALUE, OP AMP, AND CYLINDER CHARACTERISTICS & THE CORRECTION FACTOR DERIVED FROM EMPIRICAL DATA-LOAD AS (SWV)
7079
1ST PASS BIT SET ?
NO
YES
7080
CALCULATE POINT DURING SWING THAT STARTS RAMP DOWN TO SLOW SWING RATE AS RATIO OF (SR); (MAX RATE) - LOAD AS (RSS)
7081
3
8
7082
SWING TIMER SET ?
NO
7083
SET SWING TIMER (LATCH)
YES
7084
1
9

12000
CALCULATE AVERAGE POWER, NORMAL FORCE EDGELOAD, SWING RATE FOR PREVIOUS SWING
12002
CALC. AVG TIME/5°
12004
IF AVG POWER AND AVG NORMAL FORCE > LIMITS
12006
YES
CALCULATE NEW PLUNGE USING AVG NORMAL FORCE POWER AND THEIR LIMITS
GOTO 12024
NO
IF AVG NORMAL FORCE > LIMIT
12010
YES
CALC. NEW PLUNGE FROM AVG FORCE AND LIMIT
12012
GOTO 12024
NO
IF AVG POWER > LIMIT
12014
YES
CALC. NEW PLUNGE FROM AVG POWER AND LIMIT
12016
GOTO 12018
GOTO 12024

GOTO 12018

12018
12020
IF AVG POWER AND AVG NORMAL FORCE < LIMITS
YES
CALCULATE NEW PLUNGE USING AVG POWER NORMAL FORCE AND LIMITS
NO
12022
SET NEW PLUNGE TO PREVIOUS PLUNGE
12024
RESET SUMS TO 0
12026
12028
CHECK MODE
MODE 1
GOTO MODE 1
MODE 2
12030
GOTO MODE 2
MODE 1
SEND STATUS, NEW PLUNGE, LAST SWING RATE, PLUNGE RATE TO 85
12032
GOTO MAIN PROG.
12034

METHOD AND APPARATUS FOR AUTOMATICALLY CONTROLLING A MINING MACHINE

This application is a division of application Ser. No. 07/701,503, filed May 16, 1991 now U.S. Pat. No. 5,205,612.

BACKGROUND OF THE INVENTION

This invention relates to transport apparatus.

This invention has particular but not exclusive application to excavating apparatus, and for illustrative purposes reference will be made to such application. However, it is to be understood that the transport apparatus of this invention could be used in other applications, such as cross-country transport.

A continuous mining machine typically comprises a mining head supported by a head transport apparatus which guides the mining head in a desired direction of excavation and provides the stabilizing forces necessary to resist the cutting forces applied at the mining head, as the latter must of necessity overhang the front of the transport apparatus.

Where the cutting forces are relatively light, such as in the mining of soft materials like coal, the transport apparatus may include a pair of crawler tracks, and the dead weight of the transport may be sufficient to prevent it from overbalancing. Where the cutting forces are relatively high, such as in the mining of hard rock, it becomes necessary to provide further stabilization for the transport apparatus, such as may be obtained by clamping it against the walls of the tunnel being out.

DISCUSSION OF THE PRIOR ART

Continuous mining machines intended for the cutting of hard rock have been developed over a number of years. A number of these have utilized the principle of cutting with cutters disposed about a cutting wheel rotated about a transverse axis and slewed transversely about a vertical axis to form a tunnel with a flat floor or roof and curved side walls. Seberg (U.S. Pat. No. 976,703) discloses such a cutting wheel supported on a pair of spaced supporting trucks, while App (U.S. Pat. No. 1,290,479) utilizes a chain-driven cutting wheel supported on a rail-mounted carriage. Auger-type cutters supported on a crawler-undercarriage form the basis for the mining machine disclosed by Bradthauer (U.S. Pat. No. 3,290,095). Fink (U.S. Pat. No. 4,035,024) utilized roller-type cutters mounted on the periphery of a horizontal cutting wheel to cut a shallow trench in hard rock. While such roller-cutters are more effective and longer-lasting than picks in cutting hard rock, the cutting wheels could not slew, and the carriage supporting the wheels advanced against a support frame clamped to the walls of the trench.

Sugden, et al (U.S. Pat. No. 4,548,442) discloses a mining machine utilizing a cutting wheel rotatable about a horizontal axis and supporting a plurality of roller-cutters around its periphery. The cutting wheel is supported by a slewable boom, permitting the cutting wheel to excavate a tunnel with a flat floor and roof and elliptical side walls. The slewable boom is supported on a carriage which may slide longitudinally relative to an undercarriage to urge the cutting wheel into the advancing face of the tunnel. The undercarriage includes crawler tracks for accommodating advancing of the complete machine, and upper and lower jacks for clamping the undercarriage between the tunnel roof and floor.

In practice, this arrangement produced a workable mining machine, but the flexibility of the structure supporting the cutting wheel resulted in high levels of vibration between the roller-cutters and the mining face, reducing the effectiveness of the cutting process. In addition, the rolling cutters were distributed over a plurality of cutting planes, emulating to some degree the spaced relationship employed on tunnel boring machines, in which application rolling cutters were first utilized. Such a cutter distribution is wasteful when applied to a slewing cutting wheel however, as only cutters in the leading plane perform useful work when the cutting wheel slews across an excavation face.

SUMMARY OF THE INVENTION

The present invention aims to alleviate the above disadvantages and to provide excavating apparatus which will be reliable and efficient in use. Other objects and advantages of this invention will hereinafter become apparent.

With the foregoing and other objects in view, this invention in one aspect resides broadly in a mobile mining machine suitable for cutting a tunnel in rock, said mobile mining machine including:

an elongate main beam supported at longitudinally spaced locations by first beam support means and second beam support means, said first beam support means including a travel assembly adapted for relatively free longitudinal movement along the floor of the tunnel and said second beam support means including clamping means which may be selectively clamped to the walls of said tunnel;

a boom pivot adjacent said first beam support and having a substantially vertical pivot axis substantially perpendicular to then longitudinal axis of said main beam assembly;

a boom assembly attached to said boom pivot for pivotal movement thereabout;

slewing means extending between said boom assembly and said main beam assembly for controlling pivotal movement of said boom assembly about said boom pivot;

a cutting wheel assembly supported at the free end portion of said boom assembly, said cutting wheel assembly having an axis of rotation substantially co-planar with said longitudinal axis and substantially perpendicular to said boom pivot axis and having a plurality of roller-cutter assemblies mounted about its periphery;

drive means for rotating said cutting wheel assembly, and advancing means for longitudinally advancing said main beam assembly relative to said second beam support means. The clamping means may be selectively clamped to the vertical or horizontal walls of the tunnel.

Preferably, the travel assembly includes a transversely-spaced pair of crawler tracks joined to the main beam assembly through transverse crawler pivots such that the main beam may tilt within a longitudinal vertical plane about said crawler pivots for alterations to the vertical alignment of the cutting wheel. The travel assembly may also include substantially vertical steering pivots whereby the crawler, wheels or the like may be steered relative to the main beam assembly for enhanced manoeuverability of the mining machine. Of course, if desired, the travel assembly may include road wheels or rollers, or track wheels running on tracks laid along the tunnel floor. The travel assembly may also include travel drive operable to assist advancing said cutting wheel against the advancing face of the tunnel.

The clamping means may include horizontal actuators for moving the adjacent portion of said main beam transversely relative to the tunnel and vertical actuators for moving the adjacent portion of said main beam vertically relative to the tunnel, whereby control may be exercised over the horizontal and vertical alignment of the tunnel being out by altering the alignment of the cutting wheel relative to the travel assembly.

A preloading assembly may be provided, and may be attached to the main beam assembly for selective engagement with the roof of the tunnel such that the location of the boom pivot may be held relative to the tunnel against disturbing forces in excess of those which may be resisted by the weight of the mining machine alone. The preloading assembly include an actuator adapted for applying a predetermined level of force to the tunnel roof, and may include a crawler assembly, a wheel, a roller or a slide assembly such that the main beam may advance along the tunnel while maintaining the desired level of preload.

The mobile mining assembly may further include a rear auxiliary assembly comprising a rear frame supported on a rear travel assembly and attached to the rear portion of the main beam assembly through a rear pivot such that the mining machine may be relocated by travel on the assembly and the rear auxiliary assembly with the clamping frame detached from the tunnel walls. Suitably the rear pivot includes a ball or universal joint such that the main beam assembly and the rear auxiliary may articulate relative to one another and substantially vertical-axis steering slide such that unevenness in the tunnel floor may be accommodated. Steering means may be associated with the vertical steering slide such that pivoting of the rear auxiliary assembly relative to the main beam may be achieved for steering purposes.

In a further aspect of this invention, a transport assembly is disclosed, comprising:

an elongate main beam assembly supported at longitudinally spaced locations by first beam support means and second beam support means, said first beam support including a travel assembly adapted for relatively free longitudinal movement and said second beam support includes a rear travel assembly attached to the rear portion of said main beam assembly through a rear pivot. The rear pivot may include a ball joint supporting a vertical steering slide, and steering means for rotating the rear travel assembly about the ball joint relative to the main beam assembly such that steering of the transport assembly may be accomplished. Preferably, the travel assembly includes a pair of transversely-spaced crawler tracks for movement over uneven ground, and the rear travel assembly may also include crawler tracks if desired.

In a further aspect, this invention resides in a cutter wheel assembly including a cutting wheel having a peripheral wheel rim supporting a plurality of main wheel cutters having cutting rims disposed substantially within a single cutting plane, and vertical to the cutter wheel axis. Preferably a plurality of gauge wheel cutters are disposed on either side of the plane of the cutting rims and the gauge axes about which said gauge wheels rotate are substantially inclined to said main cutting plane. In this way, a substantially continuous cut may be achieved on an excavation face by the operation of successive cutters as the cutting wheel rotates. This minimizes power demand relative to excavated volume, or cutting efficiency, as the spacing of successive cuts formed across a mining face may be controlled to its maximum possible value for the prevailing conditions, minimizing the degree of rock crushing required for excavation. The cutting efficiency may further enhanced by arranging the main wheel cutters and gauge wheel cutters such that the proportion of the width of the cut excavated by the gauge cutters is minimized, since their cutting efficiency is low relative to that of the main wheel cutters. In particular, the gauge wheel cutters should be mounted as close as possible along the axis to the main cutting plane, consistent with producing a cut which will provide the necessary clearance for the wheel rim and other rotating components, as well as for the re;levant boom-mounted components such as the cutting wheel drive means. Thus it is important that the wheel rim be as narrow as possible to minimize the clearance cut which needs to be excavated by the gauge cutters. In a preferred embodiment, the wheel rim is enclosed between a pair of opposed cones having a common base circle joining the portions of the cutting rims furthest from the cutting wheel axis in which the included angles at the apexes of the cones are maximized, and are at least one hundred and twenty degrees. In order to minimize the proportion of the excavating carried out by the gauge wheel cutters, the spacing between a pair of planes perpendicular to the cutter wheel axis and enclosing the cutting portions of the gauge wheel cutters should not exceed one-sixth, and preferably be less than one-tenth, of the diameter of the common base circle.

The gauge wheel cutters may be arranged for cutting at a smaller radius relative to the cutting wheel axis than the primary cutters such that the gauge cutters may engage with the mining face only at the extremities of the slewing travel of the cutting wheel while rotating clear of the excavation face formed by the main wheel cutters. Suitably, the inclination between said cutting wheel axis and said gauge axes is greater than twenty-five degrees.

Preferably, the cutting wheel is supported on a boom assembly for slewing motion about a slewing pivot axis, the slewing pivot axis being substantially perpendicular to the cutter wheel axis and coplanar with the cutting plane such that cutting forces produce minimal torque reaction about the slewing pivot axis.

The cutting wheel body is suitably formed to include a hub portion joined to a circumferential rim only by a pair of spaced frusto-conical web portions. The thickness of the web portions is set to a level adequate to withstand transverse (axial) forces applied to the cutting wheel such that transverse stiffeners are not needed. This simplifies the construction of the cutting wheel and minimizes the extent of regions of stress concentration typically associated with stiffeners.

In another aspect this invention provides a method of cutting a tunnel, including:

providing a mobile mining machine comprising an elongate main beam assembly supported at a pair of spaced longitudinal locations by a travel assembly adapted for relatively free longitudinal movement along the floor of a tunnel and a clamping frame which may be selectively clamped to the walls of said tunnel and selectively moved along said main beam, said beam assembly supporting at its front end adjacent said first beam support a boom pivot, the boom pivot axis being substantially perpendicular to the longitudinal axis of said main beam assembly, a boom assembly attached to said boom pivot for rotational movement thereabout and supporting at its free end portion a wheel pivot, the wheel pivot axis being substantially co-planar with said longitudinal axis and substantially perpendicular to said boom pivot axis, slewing means attached between said boom assembly and said main beam for controlling rotational movement of said boom assembly about said boom pivot, a cutting wheel assembly mounted to said wheel pivot for rotation thereabout and having a plurality of roller-cutter assemblies mounted about its periphery, and wheel drive means for rotating said cutting wheel assembly;

energizing said clamping means to force said clamping assembly into frictional engagement with the tunnel walls;

energizing said advancing means to force said main beam forward along the tunnel relative to said clamping means;

energizing said slewing means to sweep said cutting wheel assembly across the advancing face of the tunnel;

energizing said wheel drive means to rotate said roller-cutter assemblies about said wheel pivot axis;

de-energizing said clamping means to release said clamping assembly from the tunnel walls;

energizing said advancing means in reverse function to draw said clamping assembly forward relative to said main beam and the tunnel.

In another aspect this invention includes a method of forming a mobile mining machine, including:

providing an elongate main beam assembly supported at a pair of spaced longitudinal locations by a travel assembly adapted for relatively free longitudinal movement along the floor of a tunnel and clamping means which may be selectively clamped to the walls of said tunnel and selectively moved longitudinally relative to said main beam by advancing means, said main beam assembly supporting at its front end adjacent said first beam support a boom pivot, the boom axis of rotation of said boom pivot being substantially perpendicular to the longitudinal axis of said main beam assembly;

providing a boom assembly attached to said boom pivot for rotational movement thereabout, said boom assembly supporting at its free end portion a wheel pivot, the wheel axis of rotation of said wheel pivot being substantially co-planar with said longitudinal axis and substantially perpendicular to said boom pivot axis;

providing slewing means attached between said boom assembly and said main beam assembly for controlling rotational movement of said boom assembly about said boom pivot;

providing a cutting wheel assembly mounted to said wheel pivot for rotation thereabout and having a plurality of roller-cutter assemblies mounted about its periphery;

providing wheel drive means for rotating said cutting wheel assembly; and assembling said main beam assembly, said boom assembly, said slewing means, said cutting wheel assembly and said wheel drive means to form said mobile mining machine.

In a further aspect, this invention resides in a method of controlling a mobile mining machine of the type having a cutting wheel rotatable about a horizontal axis by wheel drive means and traversable across a mining face in order to maximize its mined output consistent with maintaining cutter wheel power below a desired limit, including selectively controlling the kerf depth and kerf spacing such that the kerf ratio of kerf depth to kerf spacing approaches the optimum value for the rock being cut by continuously monitoring the wheel drive means power input and altering the speed of the slewing means to vary the traversing speed and thus the kerf spacing to maintain said power input close to a predetermined level. The method may further include the monitoring of changes in rock properties transversely across a rock face by storing kerf-spacing information for a traverse of said cutting wheel and utilizing said kerf-spacing information to control the kerf spacing or the kerf depth during successive traverses.

Force-measurement transducers may be provided for monitoring selected forces applied to the cutting wheel by the cutting process, and the output from the force-measurement transducers may be applied to the feedback control system for reducing the speed of the slewing means as required to maintain the selected forces below pre-determined limits such that the method of control may not result in the application of undesirable levels of force to the mining machine.

The gripper assembly may include traverse means for moving the portion of the beam member engaged therewith, whereby the excavation head may be steered vertically and/or horizontally as desired for excavating a tunnel of a desired curvature.

An auxiliary transport assembly may be attached to the free end portion of the beam member by connection means and may be powered for urging the excavation apparatus forward or rearward as desired, such as when moving the excavation apparatus to or from an excavation site. Suitably, the connection means includes a ball joint in series with a vertical slide such that the inclination of the beam member in the vertical plane may be controlled by interaction with the gripper assembly while permitting the second transport assembly to align itself independently with the floor of the tunnel.

In another aspect, this invention resides in a method of forming an excavating apparatus, including:

providing an excavating head for excavating material from an excavating face;

providing a transport assembly adapted for supporting said excavating head for movement towards the excavated face;

providing biasing means for biasing said excavating head into engagement with the excavated face;

providing traversing means for moving said excavating head across the excavated face such that material may be excavated progressively from selected portions of the excavated face, and assembling said excavating head, said transport assembly, said biasing means and said traversing means to form said excavating apparatus.

DESCRIPTION OF THE PREFERRED EMBODIMENT

In order that this invention may be more easily understood and put into practical effect, reference will now be made to the accompanying drawings which illustrate a preferred embodiment of the invention, wherein.

Figure 1:
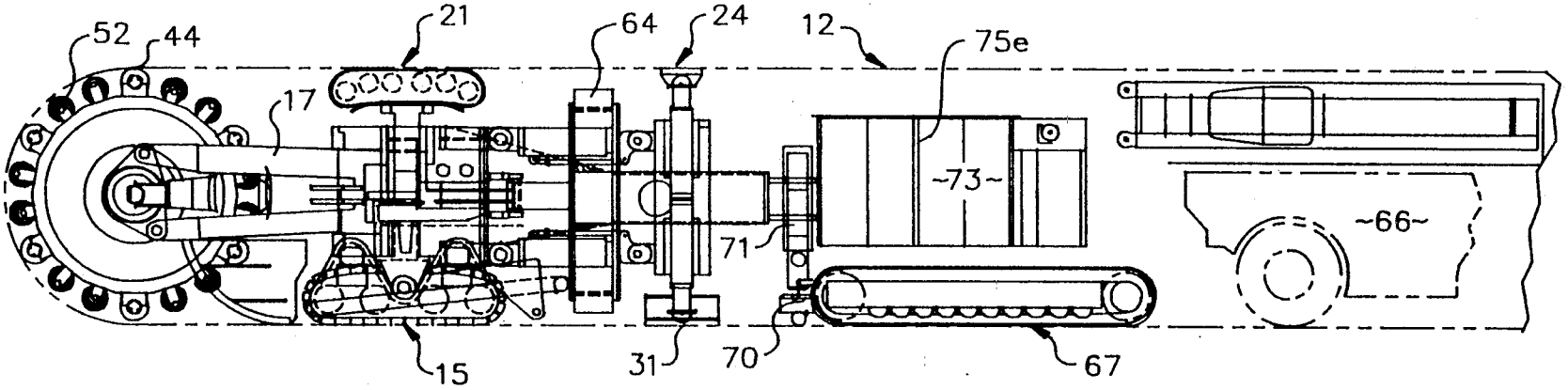
FIG. 1 is a side view of a mobile mining apparatus according to the invention.
Figure 2:
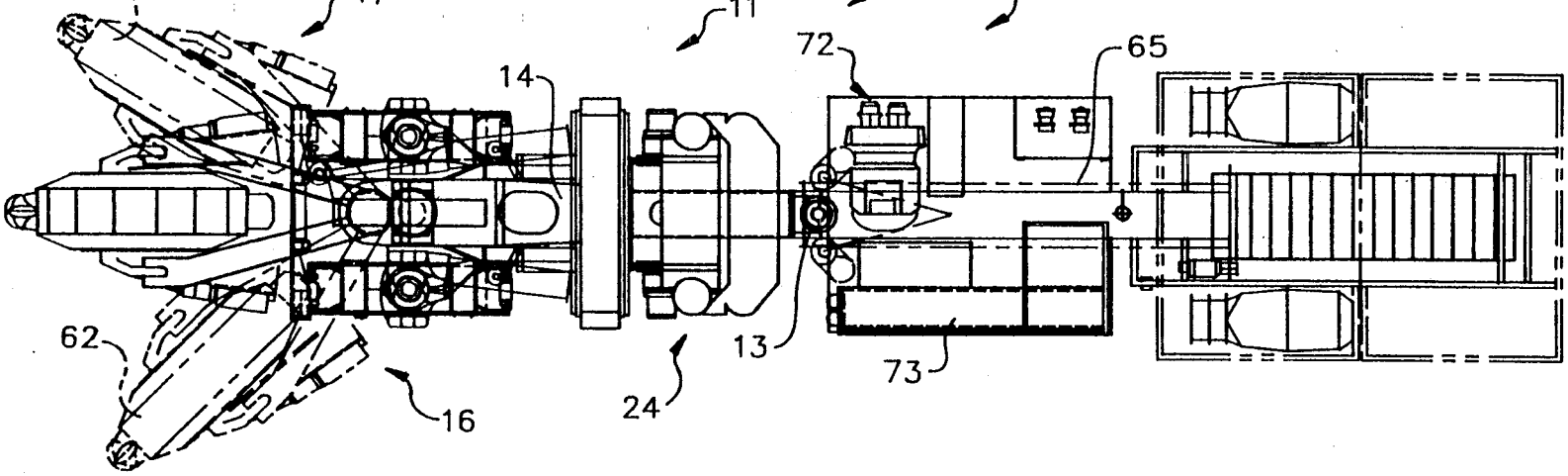
FIG. 2 is a top view of the mobile mining apparatus shown in FIG. 1.
Figure 3:
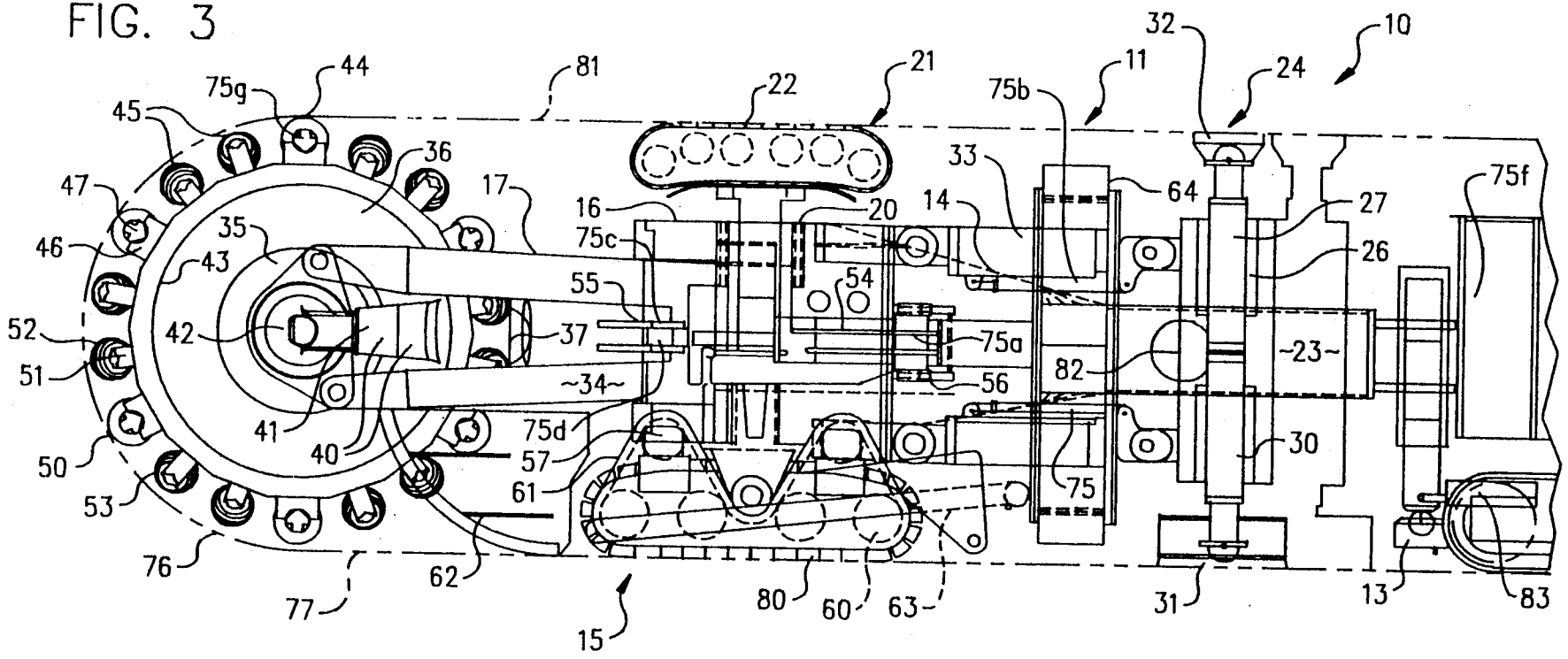
FIG. 3 is a partial side view of the mobile mining apparatus.
Figure 4:
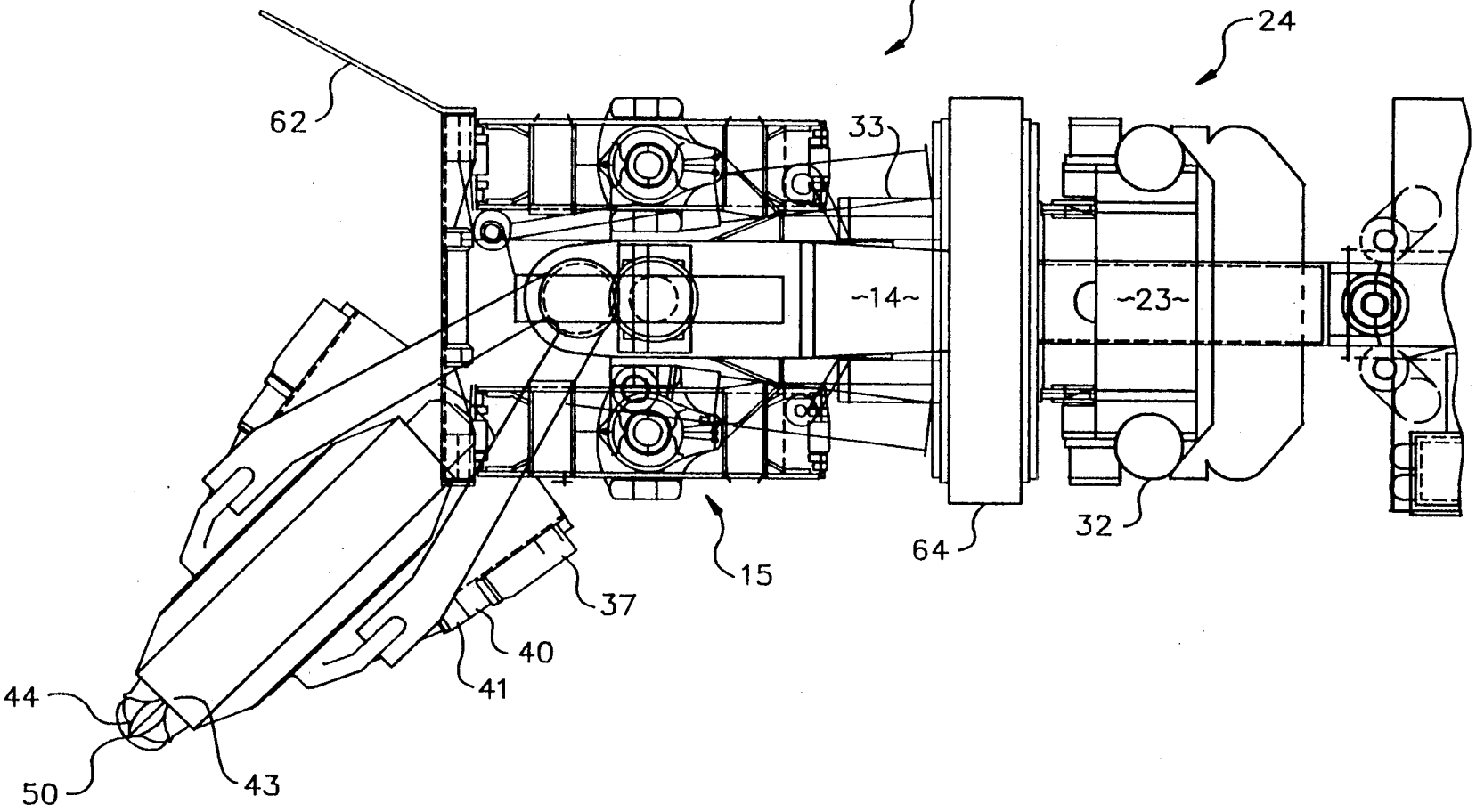
FIG. 4 is a partial top view of the mobile mining apparatus.
Figure 5:
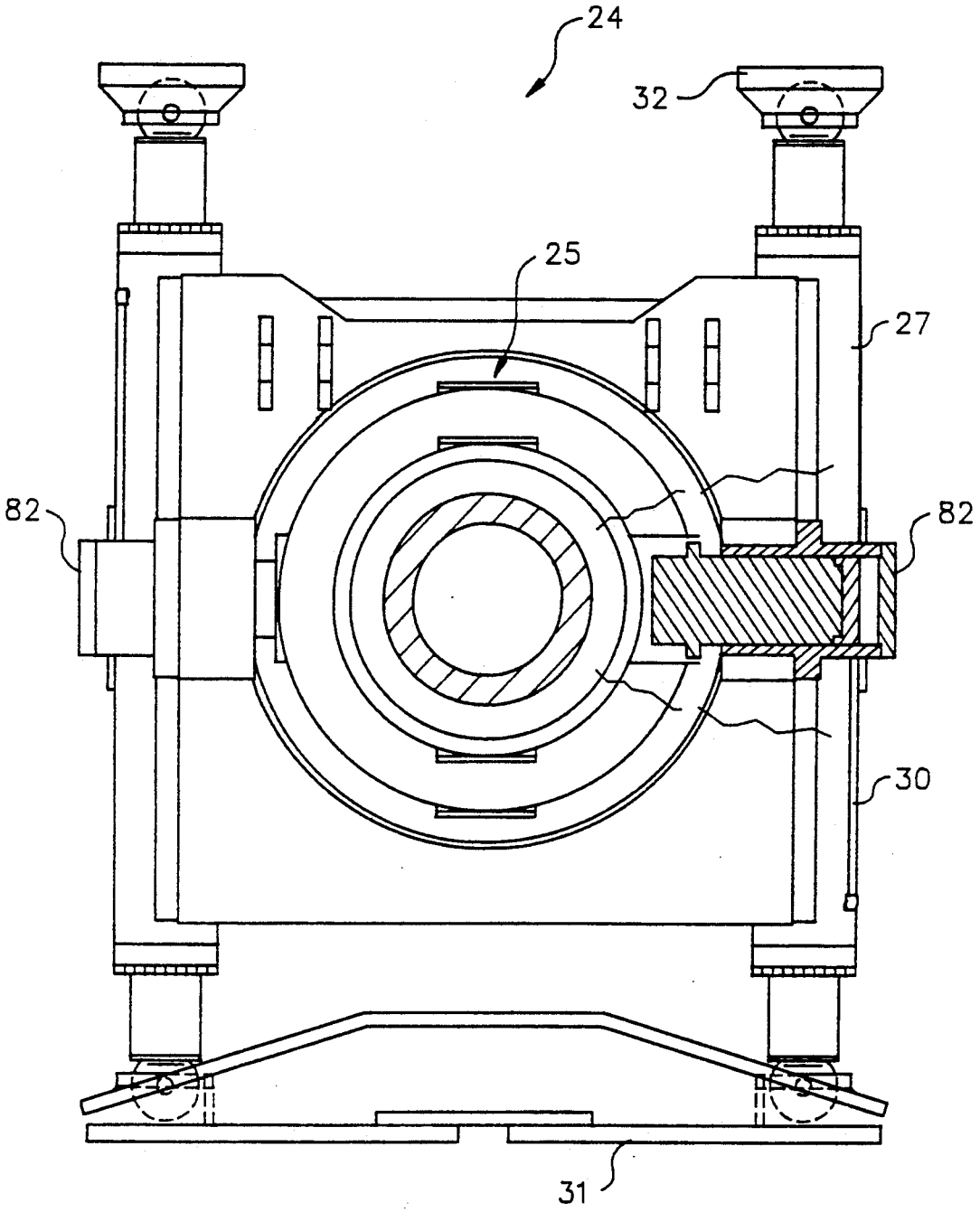
FIG. 5 is a cross-sectional view of the gripper assembly of the mining apparatus.

The mobile mining apparatus 10 shown in FIGS. 1, 2, 3 and 4 comprises a front travel assembly 11 and a rear travel assembly 12 joined at a coupling 13. The front travel assembly 11 is constructed around a main beam assembly 14 which is supported at its front end on crawler assemblies 15. The front portion of the main beam assembly 14 includes a vertical-axis boom pivot 16 to which a boom assembly 17 is pivoted for traversing motion from side to side. Directly behind the upper portion of the vertical boom pivot 16, a vertical preload cylinder 20 is formed in the main beam assembly 14 and supports a preload assembly 21 including a preload crawler 22.

The main beam assembly 14 terminates rearwardly in a longitudinal guide tube 23, to the free end of which the coupling 13 is attached. A gripper assembly 24 is mounted slidably about the guide tube 23, and a two-axis gimballed yoke assembly 25 mounted to the gripper assembly 24 slides on the guide tube 23. The gripper assembly 24 has a gripper body 26 to the sides of which opposed pairs of upper gripper cylinders 27 and lower gripper cylinders 30 are attached. The free ends of the latter are joined to the outer ends of a floor gripper 31, while the upper gripper cylinders 27 terminate at their free ends in individual roof grippers 32. The gripper body 26 is coupled to the main beam assembly 14 via substantially horizontal plunge cylinders 33.

The boom assembly 17 comprises a boom 34 supporting a planetary reduction gearbox assembly 35 about which a cutting wheel 36 revolves, the gearbox assembly 35 being driven by two cutting wheel drive motors 37 through fluid couplings 40, clutches 41 and bevel input drives 42. The rim 43 of the cutting wheel 36 supports a ring of roller cutter assemblies 44 all disposed substantially in a plane normal to the cutting wheel axis, and outer rings of gauge cutter assemblies 45. Each roller cutter assembly 44 comprises a roller trunnion 46 within which a roller 47 including a central cutting flange 50 may rotate about an axis parallel to the cutting wheel axis. All of the roller cutter assemblies 44 are mounted with their cutting flanges 50 within a common plane perpendicular to the cutting wheel axis. Gauge cutter assemblies 45 comprise gauge trunnions 51 within each of which a gauge roller 52 studded with high-hardness "buttons" 53 may rotate about a gauge axis disposed at a substantial angle to the cutting wheel axis. If desired, the gauge cutters may utilize disc cutters similar to the roller cutter assemblies 44.

The rim 43 and other rotating components are fully enclosed within a pair of cones 92 which share a base circle 93 joining the portions of the cutting flanges 50 which are furthest from the cutting wheel axis, and have included angles at their apexes which are greater than one hundred and twenty degrees, minimizing the clearance necessary outside the portion of the face 76 which is out by the cutting flanges 50. The gauge cutters 45 are contained between a pair of planes 94 which are perpendicular to the cutting wheel axis and are spaced apart by a distance which is less than one-tenth of the diameter of the base circle 93. These proportions provide adequate clearance for the operation of a cutting wheel 36 of the proportions defined by the cones 92, while minimizing the excavation which must be performed by the gauge cutters.

Swing cylinders 54 are connected between boom lugs 55 formed on the sides of the boom 34 and beam lugs 56 formed on the main beam assembly 14 for rotating the boom assembly 17 about the vertical pivot 16. Crawler drive motors 57 are attached to the frames of the crawler assemblies 15 and drive the crawler idlers 60 through drive chains 61. Scraper plates 62 attached to the main beam 14 and shaped to fit the tunnel bored by the mining apparatus 10 confine cut rock to the region ahead of the crawler assemblies 15. A primary conveyor 63 transports cut rock from ahead of the scraper plates 62 into the lower portion of a carousel conveyor 64 which discharges it onto a secondary conveyor 65 running above the main beam assembly 14 to the rear of the mining apparatus 10 where it may be discharged into a bulk transport vehicle 66.

The rear assembly 12 is supported on rear crawlers 67, and the coupling 13 includes a ball joint 70 permitting articulation in both horizontal and vertical directions, and a vertical slide-pivot 71, permitting the rear travel assembly 12 to move up or down independently of the motion of the main beam assembly 14, and to pivot transversely relative thereto. The crawler assemblies 15 and 67 may include transverse gripper treads for enhancing the traction when driven, but it is preferred that they include plain crawlers, and that the desired traction be attained as a result of generating a desired level of preload on the crawler.

The rear travel assembly 12 carries hydraulic pumps 72 for operating the hydraulic cylinders and electrical control cubicles 73 for controlling the operation of electric equipment including the cutting wheel drive motors 37. The control cubicles 73 also house a programmable logic controller (PLC) for controlling the overall operation of the mining apparatus 10.

Swing cylinder length transducers 75*a* are attached to the swing cylinders 54 and are wired to the PLC 74 to allow the transverse horizontal inclination of the boom assembly 17 relative to the main beam 14 to be monitored. Cylinder length transducers 75*a* (boom swing cylinder position transducers) are preferably Temposonics linear displacement transducers manufactured by Temposonics, Research of Triangle Park, N.C. Additional transducers include beam propel cylinder position transducers 75*b*, which measure cylinder extension (which relates directly to beam position). Beam propel cylinder position transducers 75*b* are also preferably Temposonics linear displacement transducers, described above. Also, boom pivot pin strain gauge 75*c*, which measures boom force, may be employed. Boom pivot pin strain gauge 75*c* is preferably a Series 125 strain gauge manufactured by Micro-measurements of Raleigh, N.C. Boom swing cylinder pin strain gauge 75*d* measures swing cylinder force, and is preferably a Micro-measurements Series 125 strain gauge discussed above. Boom swing pressure transducer 75*e* measures the swing system hydraulic pressure and is preferably a model 811 FMG transducer manufactured by Sensotec of Columbus, Ohio. Cutterhead drive motor current sensor 75*f* measures cutterhead motor current, which relates to power, and is preferably model CT5-005E manufactured by Ohio Semitronics, Inc. of Columbus, Ohio.

To excavate a face 76 at the end of a tunnel 77, the cutting wheel 36 is rotated by the cutting wheel drive motors 37, and the gripper assembly is clamped rigidly between the floor 80 and the roof 81 of the tunnel 77 by extending the gripper cylinders 27 and 30. The cutting flanges 50 of the roller cutter assemblies 44 are urged into engagement with the face 76 to be excavated by extending the plunge cylinders 33. The swing cylinders 54 are then operated to traverse the boom assembly 17 about the boom pivot 16, and the cutting flanges 50 of the rollers 47 score cutter path lines in the face 76, and, provided that the cutter path lines are deep enough relative to their spacing, the material between adjacent cuts will break away from the face 76. As the boom assembly 17 traverses to the desired extent of tunnel width on one side, the gauge cutter assemblies 45 engage with the face 76, forming the edge of the tunnel. The plunge cylinders 33 are extended to advance the rollers 47 into the face 76, the traversing direction of the boom 17 is then reversed, and the excavation process continues, extending the tunnel 77. The length by which the plunge cylinders 33 are extended each cycle is controlled to a pre-determined value by the PLC 74 using length information fed to it from the beam propel cylinder position transducers 75*b*, and the cutterhead motor current from cutterhead motor current transducer 75*f*.

When it is desired to alter the vertical direction in which the mobile mining apparatus 10 is excavating along the tunnel 77, the upper and lower gripper cylinders 27 and 30 are selectively actuated to move the gripper body 26 relative to the tunnel 77. This tilts the main beam assembly 14 through the interaction of the yoke assembly 25 and the guide tube 23. When it is desired to alter the transverse direction in which mining is to occur, the transverse yoke cylinders 82 are selectively activated to move the guide tube 23 transversely relative to the tunnel 77, rotating the main beam assembly about a vertical axis. The mobile mining apparatus 10 may be steered while being moved to a further mining location along a tunnel by retracting the gripper cylinders 27 and 30 to free the gripper assembly from the floor 80 and roof 81, and utilizing steering means 83 to vary the steering angle formed between the main beam assembly 14 and the rear travel assembly 12 at the vertical slide-pivot 71.

Figure 6:
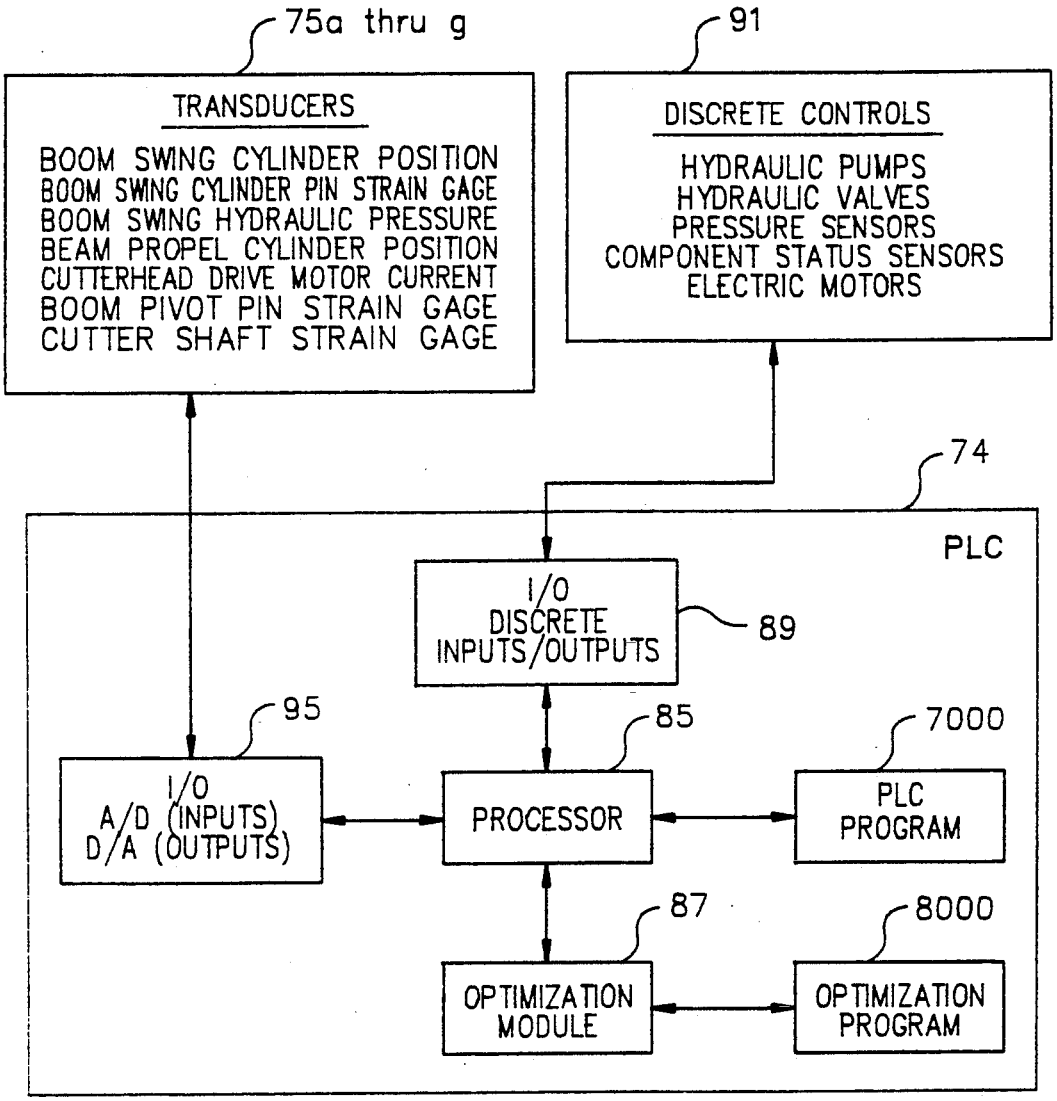
FIG. 6 is a block diagram of the apparatus for optimizing pitch and swing typifying the present invention.

As illustrated in the diagram of FIG. 6, the PLC 74 may be programmed to continuously monitor the cutter wheel drive motor power using the output from the cutter wheel drive motor current transducer 75*f*, which provides a reasonably accurate measure of motor power input for a constant-voltage supply. The measured power level is compared with the maximum power level which may be safely utilized by the cutter wheel drive system. From the swing cylinder length transducers 75*a*, the PLC 74 can also determine the angular position and slew rate of the boom assembly 17. If the measured power level is significantly lower than the maximum power level and the slew rate is below the pre-determined maximum value, the PLC 74 may control a proportional control value controlling a swing pump feeding oil to the swing cylinders 54 to increase the slew rate. As the cutting wheel 36 rotates at a relatively constant speed in this embodiment, this has the effect of increasing the pitch of the spiral lines scribed in the rock (kerf spacing) by the cutting flanges 50 during successive rotations of the cutting wheel 36. This effect increases the force applied to the cutting flanges 50 by the rock and thus increases the power demand of the cutting wheel drive motors 37. The volume of rock cut from the face 76 also increases with increased kerf spacing, and thus the output of the mobile mining apparatus may be optimized for rock with particular cutting properties. Should the cutting wheel 36 encounter harder rock as it slews across the face 76, the power demand of the cutting wheel drive motors 37 will rise, and the PLC 74 will reduce the slew rate of the boom assembly 17 until the maximum sustainable production rate consistent with the cutting wheel power limit is again reached. This form of production optimization is particularly applicable to a cutting wheel in which all of the cutting flanges 50 are co-planar and thus scribe a single spiral line across the face 76, whereby all kerf spacings are dependent only on the slew rate of the boom assembly 17 relative to the rotational speed of the cutting wheel 36.

The PLC 74 may also monitor the swing cylinder oil pressure through the boom swing hydraulic pressure sensors 75*e* to give a measure of the transverse loading on the cutting wheel 36, the boom pivot pin strain gauge 75*c* to give further information on both horizontal and vertical forces on the cutting wheel 36, and the cutter shaft strain gauges 75*g* (discussed below) to provide a measure of the direct load on one or more roller cutter assemblies 44. The computed forces are compared with predetermined limits, and the slew rate of the boom assembly 17 may be reduced below the optimum value for maximizing production to a value at which excessive stress levels are not generated on the cutters or within the structure of the mobile mining apparatus 17.

If desired, the PLC 74 may be programmed to monitor changes in rock properties, such as rock hardness, relative to cutter wheel location across the face 76 using data including the cut spacing produced by the cutter power optimization algorithm. The rock hardness map so produced from one traverse of the cutting wheel may be utilized to program controlled variations in cut spacing for a succeeding traverse. Such a hardness map may also be used to detect a substantially vertical join between an ore body and surrounding rock of differing hardness, and may be utilized to control the extent of traverse of the cutting wheel to one side such that the ore body may be selectively mined.

The PLC 74 may be further programmed to monitor the cutting forces of individual cutters, such as by the use of strain transducers or the like, and the rotational position of the cutting wheel whereby the variation in rock properties along a cutter path line may be monitored and utilized for mapping the vertical variation in rock properties of the face 76. These transducers are cutter shaft strain gauges 75*g*, preferably Series 125 strain gauges manufactured by Micro-measurements of Raleigh, N.C.

It is readily apparent that the above description pertains to optimization of rock cutting by optimization of cutterhead plunge and cutterhead sweep. This optimization of cutterhead plunger and cutterhead sweep allows fine-tuning of machine performance in various rock conditions and maximizes penetration rate without exceeding either the cutterhead drive torque limit or the cutterhead bearings load capacity. In addition, control over both the cutter penetration and the cutter path spacing gives control of the average contract stress between the rock and the cutter edges, thus improving cutter ring life. This PLC 74 monitors machine performance and derives the optimum cutter penetration and cutter path spacing that will maximize performance.

Spacing between cutter paths is a function of the number of cutters in assemblies 44 and 45 on cutter wheel 36, the revolutions per minute of cutter wheel 36 and the slew rate. Thus, the spacing between cutter paths can be changed by varying the slew rate. Specifically, an increase in the slew rate causes a proportional increase in the spacing between cuts.

Direct control over the spacing between cuts allows the cutting performance to be optimized.

In soft rocks, for example, both a large plunge and fast swing rate can be used without over loading either the cutterhead power or cutter bearings. In hard rock, on the other hand, both the plunge and swing rate can be reduced to prevent high cutter loads and edge stresses.

Referring again to FIG. 6, PLC 74 includes a processor 85 which is preferably an Allen-Bradley Model PLC-5/25 Processor with 21K of memory. PLC 74 also has an optimization module 87, preferably an Allen-Bradley 1771 DB Basic Module.

PLC 74 also includes discrete input/outputs 89 which are preferably Allen-Bradley Model 1771-IMP, Model 1771-OMD, Model 1771-IBD and Model 1771 CBD, and which access discrete controls 91 such as hydraulic pumps, hydraulic values, pressure sensors, component status sensors, and electric motors known in the art. The A/D inputs and D/A outputs 95 of PLC 74 are preferably Allen-Bradley Model 1771-IFE and Model 1771-OFE, and access transducers 75*a*–75*g* discussed above. Processor 85 is connected to optimization module 87, discrete input/outputs 89, A/D inputs and D/A outputs 95, and is controlled by PLC program 7000 to be explained in further detail below. Optimization module 87 is controlled by optimization program 8000, discussed in detail below.

PLC 74, and specifically processor 85 in conjunction with PLC program 7000, controls the following functions of mobile mining apparatus 10: tramming from site to site, conditioning the face, overcutting the back for cutter replacement, unattended operation through one propel stroke, regrip at end of propel stroke, horizontal and vertical steering, curve development, fire detection and suppression, cutterhead boom swing angle, cutterhead boom swing rate, and cutterhead plunge depth.

Optimization module 87, in conjunction with optimization program 8000, analyzes machine data performance sent by processor 85. Specifically, processor 85 sends data based on cutterhead drive motor amperage, swing cylinder extension cutter loads and boom forces to optimization module 87.

From this data optimization module 87 will calculate the cutter penetration (plunge) and the spacing between cuts (swing rate) required to maximize machine performance in the rock being mined. In weak rocks, this will be the deepest plunge and highest slew rate that fully utilizes the available cutter wheel drive power without exceeding the maximum allowed slew angle (the angle between the cutter paths and the vertical). In hard rocks, limitations such as the bearing load capacity of the cutters are expected to restrict the penetration and slew rate, causing the machine to operate below the maximum cutter head power.

For optimization module 87 to send updated plunge depth and swing rate instructions to processor 85, optimization program 8000 uses equations that define the relationships between the cutter penetration and spacing between cuts, and the resulting cutter loads, edge stresses and cutterhead power. Such equations will allow the machine to respond quickly to changing rock conditions and, thus, will allow it to achieve maximum penetrations rates over most of the cutting time.

The machine performance data that will be used by the optimization program 8000 for calculating the maximum operating conditions include the cutterhead motor amperage, cutter normal force (optional), the plunge at the beginning of each slew, and the extension of the swing cylinders. During a slew the cutterhead motor amperage, cutter normal force, and the swing cylinder extensions will be sent to the optimization module 87 at fixed intervals (presently set at 5 degrees). The motor amperage will be used to calculate the cutterhead torque and the cylinder extensions will be used to calculate the slew angle and slew rate.

The average cutter normal force (Fn) for each 5 degree slew for example will be either calculated by the optimization module 87 from the average cutterhead torque and cutter penetration as determined from the plunge and slew angle or measured directly. Normal force calculations from the cutterhead torque will be done by calculating the average tangential force on the cutters (Ft-rolling force) from the cutterhead torque and the average cutter coefficient (Ft/Fn) based on the cutter penetration. By multiplying these two values, the cutter normal force (Fn) can be determined. The cutter edge loads (i.e. force per unit contact length between the cutter and rock) can also be determined either from the cutter rolling force and cutter penetration or from the measured cutter normal force.

After the average cutter normal force, cutter edge load and cutter head drive power are known, the cutter penetration and spacing between cuts (slewing rate) that will produce the maximum machine performance can be calculated using the relationships defined by the predictor equations. This will be done with the following limitations being observed: bearing capacity of the cutters, cutterhead power limit, cutter edge load limit, and slew angle limit.

The cutter edge load limit is used to protect the cutters from excessively high edge stresses that might occur in hard rock and cause catastrophic brittle failure. It also helps to reduce the cutter wear rates caused by small scale chipping at the cutter edges and high abrasion rates. The slew angle limit is used to protect the cutters from excessively high sides loads caused by slewing and protects the cutter rings from excessive abrasive wear due to cutter skidding.

In the first mode of operation (Mode 1), the optimization module 87 and optimization program 8000 will send a new plunge rate, plunge depth, and a new average slew rate to the processor 85 once at the end of each slew. All calculations for maximizing performance will usually be made during the time that the cutterhead is ramping down just prior to contact with the side wall of the tunnel, and the new plunge and slew rate value will be passed to the processor 85 usually just prior to the start of the next swing. In this mode, the slew rate of the cutterhead will not be varied during a swing unless some overload of the cutterhead power occurs causing the processor 85 to take corrective action by slowing the slew rate or, if the overload is extremely severe, shutting down the machine. Optimum plunge depth and plunge rate are derived for each entire slew and do not change unless overload occurs.

In a second mode of operation (Mode 2) optimization module 87 and optimization program 8000 will map the tunnel face using the input data, and from this map calculate a matrix of slew rate values as a function of the slew angle. This mode of operation is useful in mixed rock conditions where the cutter loads will vary across the face. Under such conditions, reducing the slew rate over the hard rock portions of the face helps to reduce these loads by reducing the spacing between cuts. Optimum plunge depth and plunge rate are derived for each entire slew and do not change during the slew unless overload occurs.

In Mode 3, optimization module 87 and optimization program 8000 make substantially real time corrections to the slew rate during a swing. This requires substantially continuous communication (such as at 5 degree increments) between optimization module 87 and processor 85. Optimum plunge depth and plunge rate are derived for each entire slew and do not change unless overload occurs.

Figure 7A:
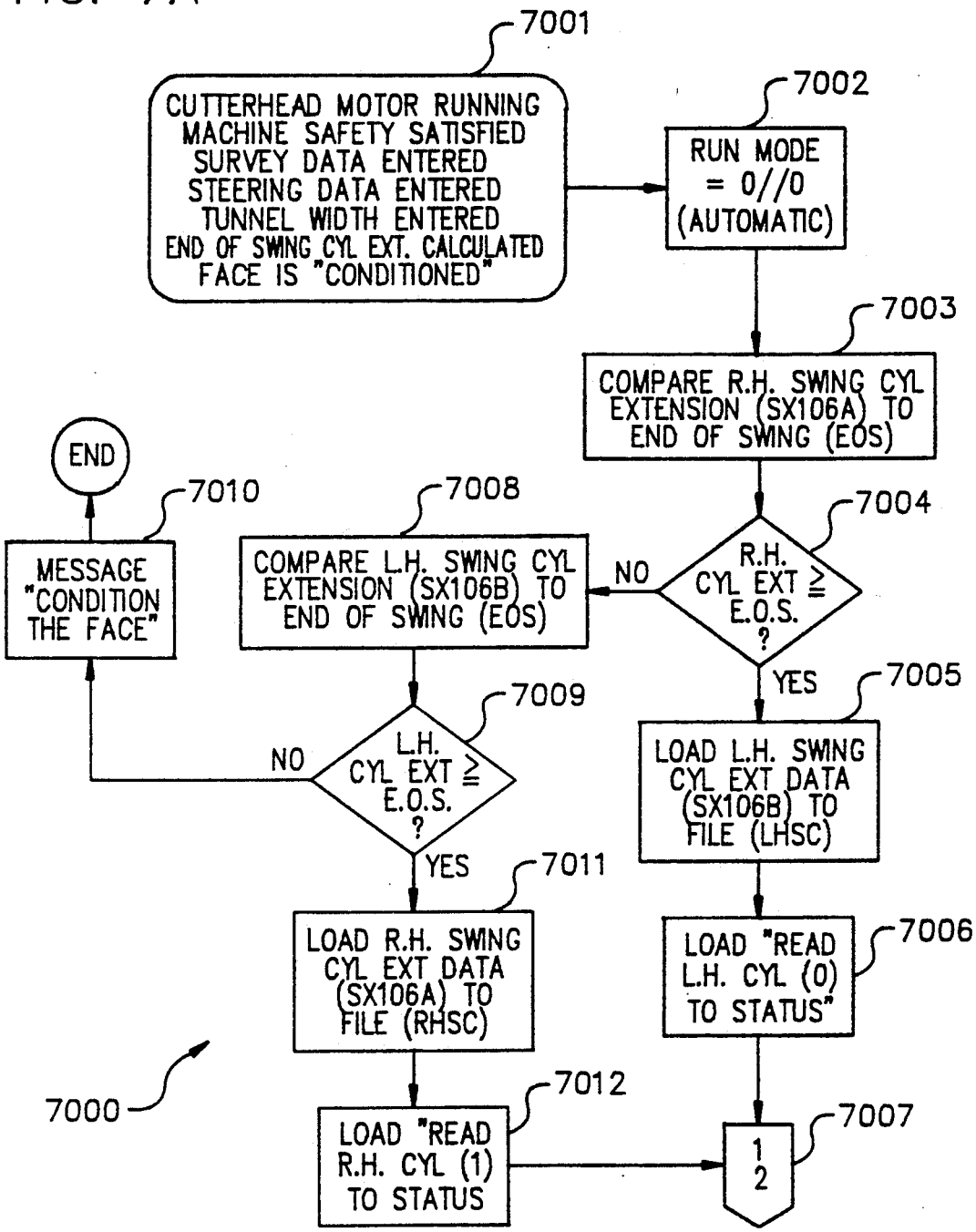
FIGS. 7A–7P is a flow chart of the P.L.C. program.
Figure 7B:
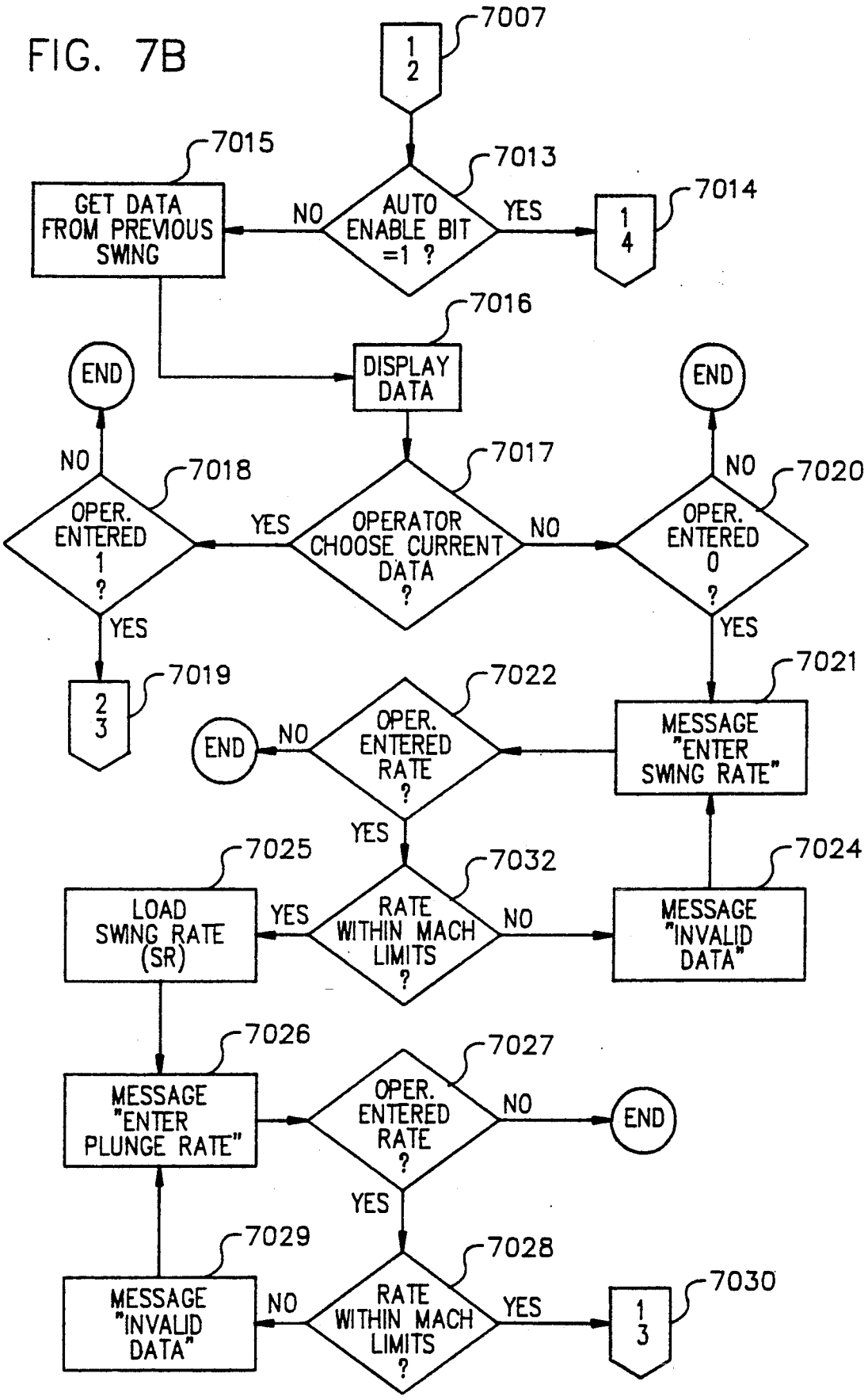
Figure 7C:
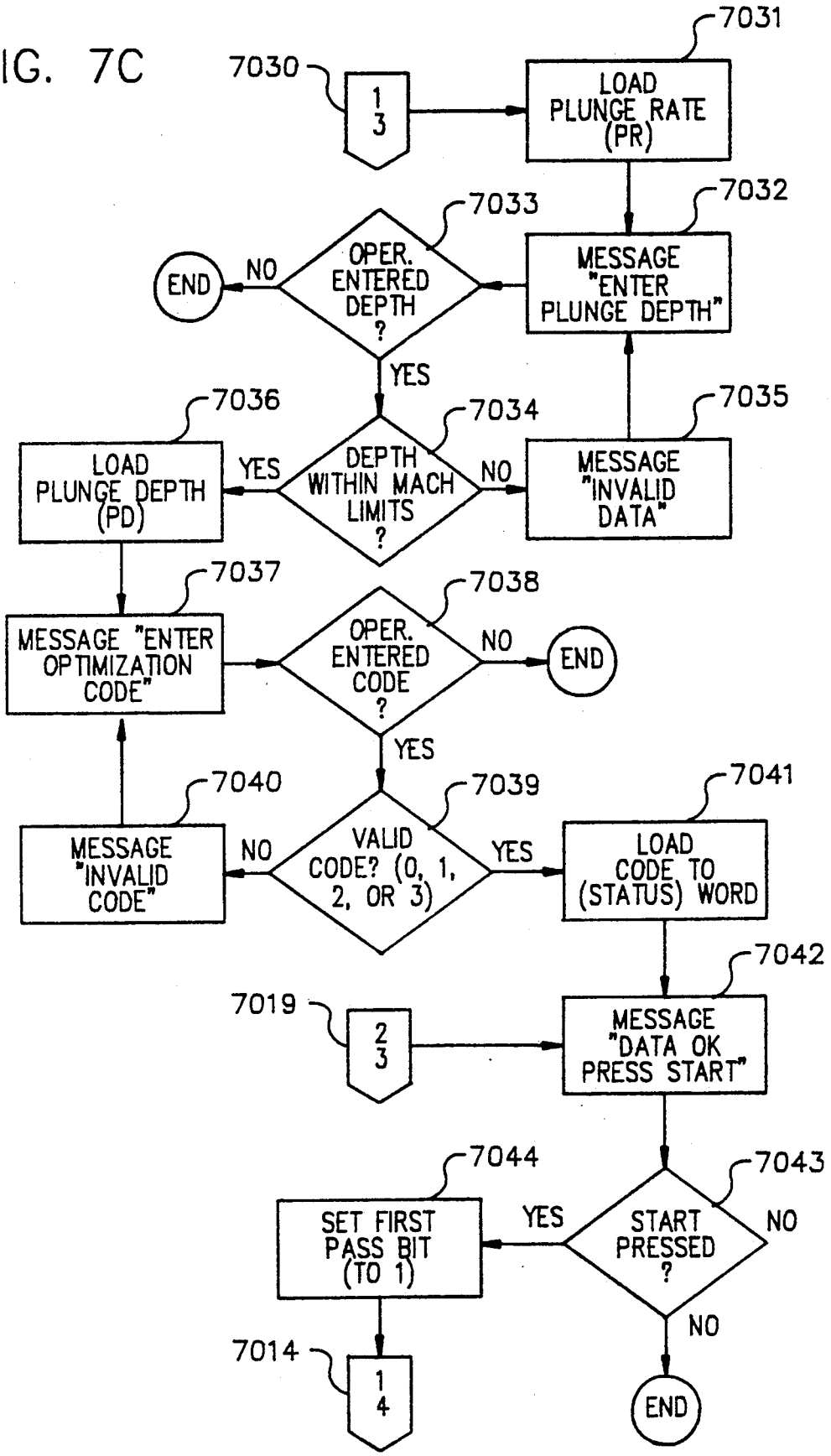
Figure 7D:
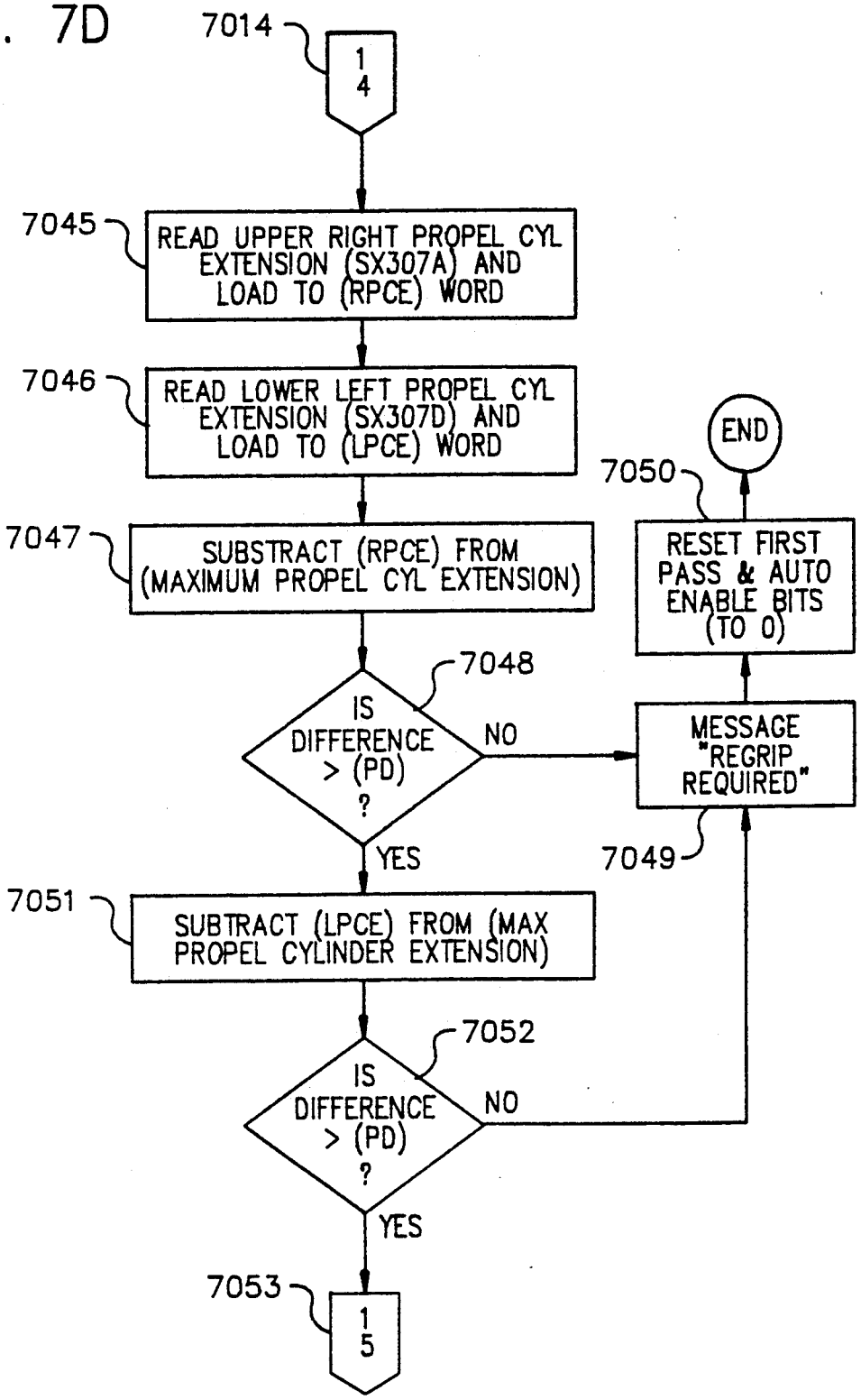
Figure 7E:
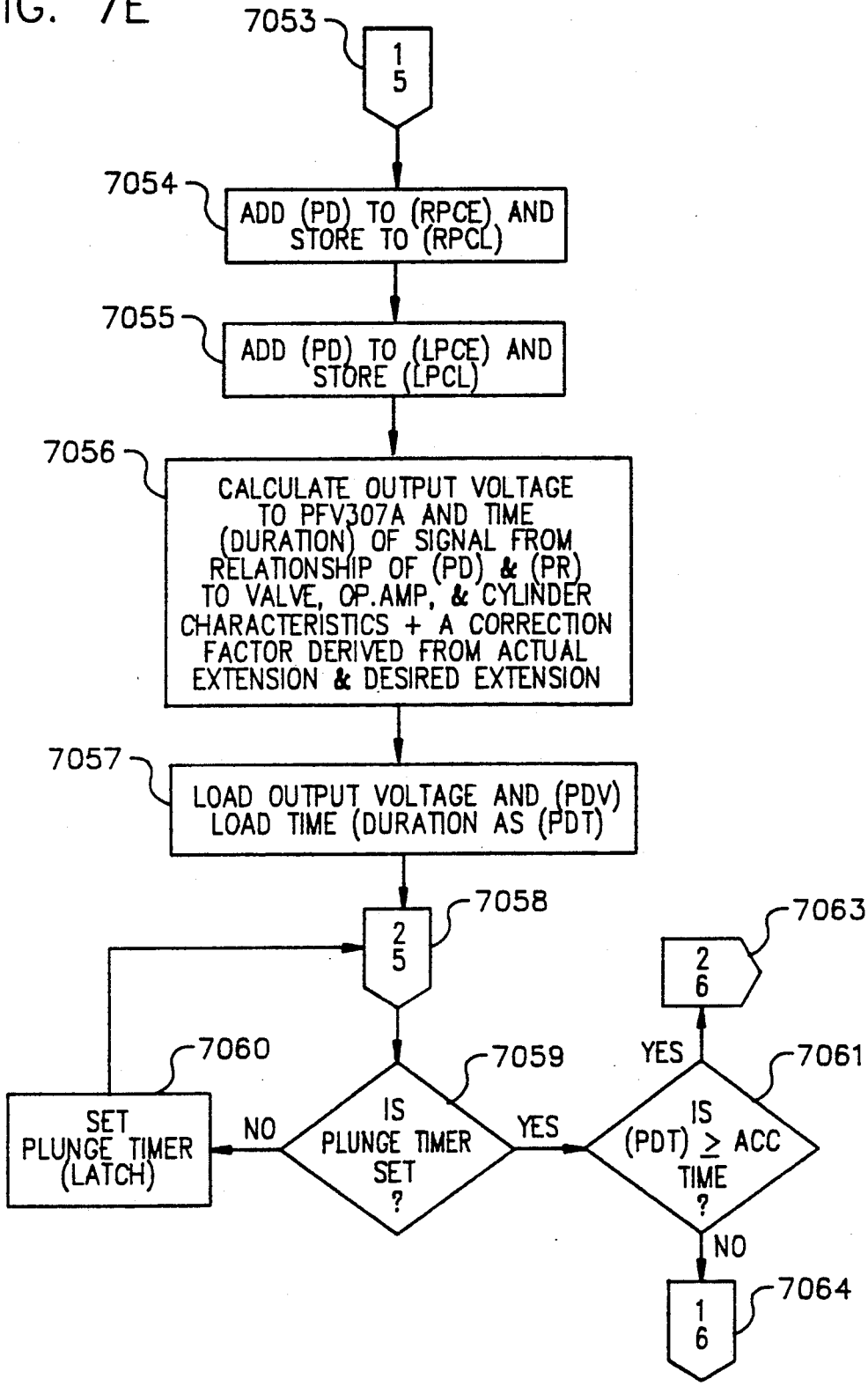
Figure 7F:
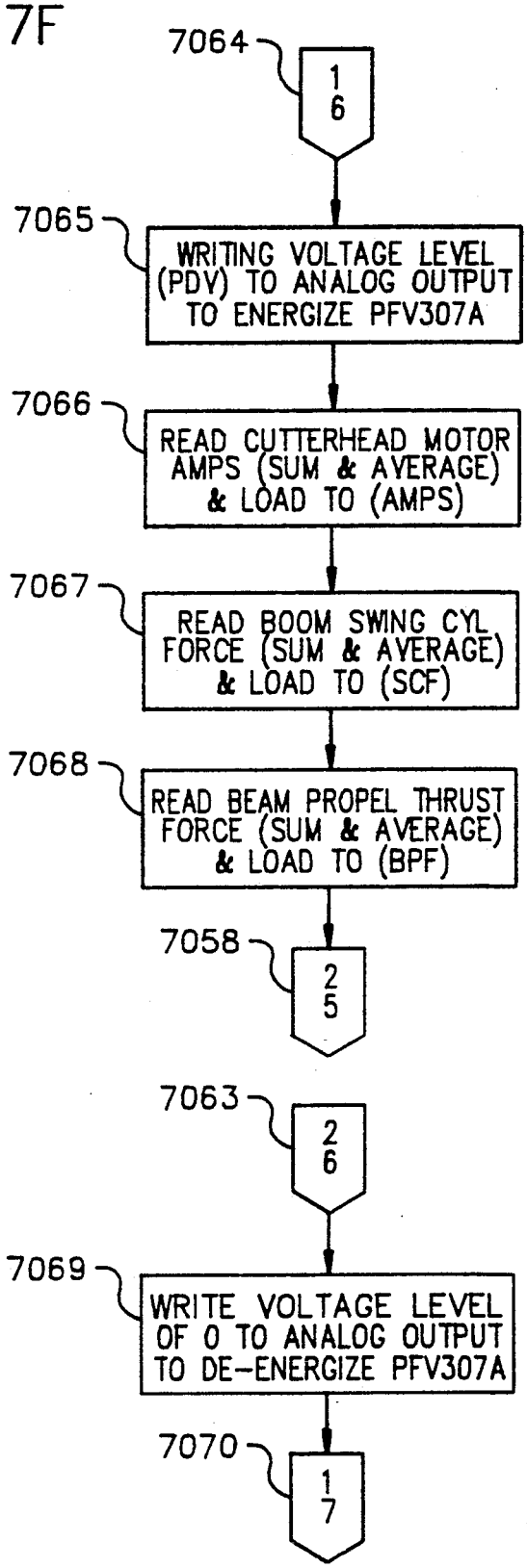
Figure 7G:
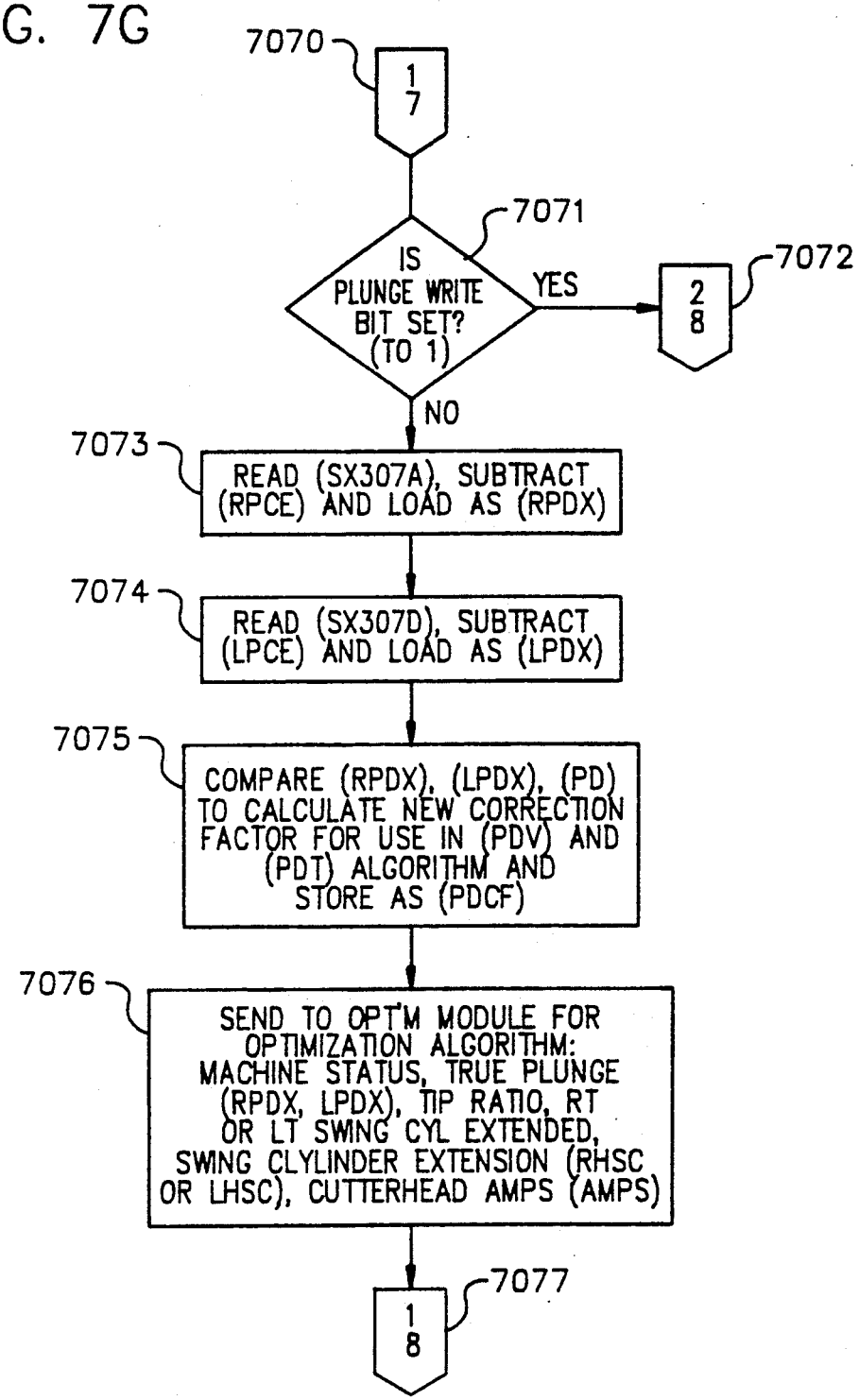
Figure 71:
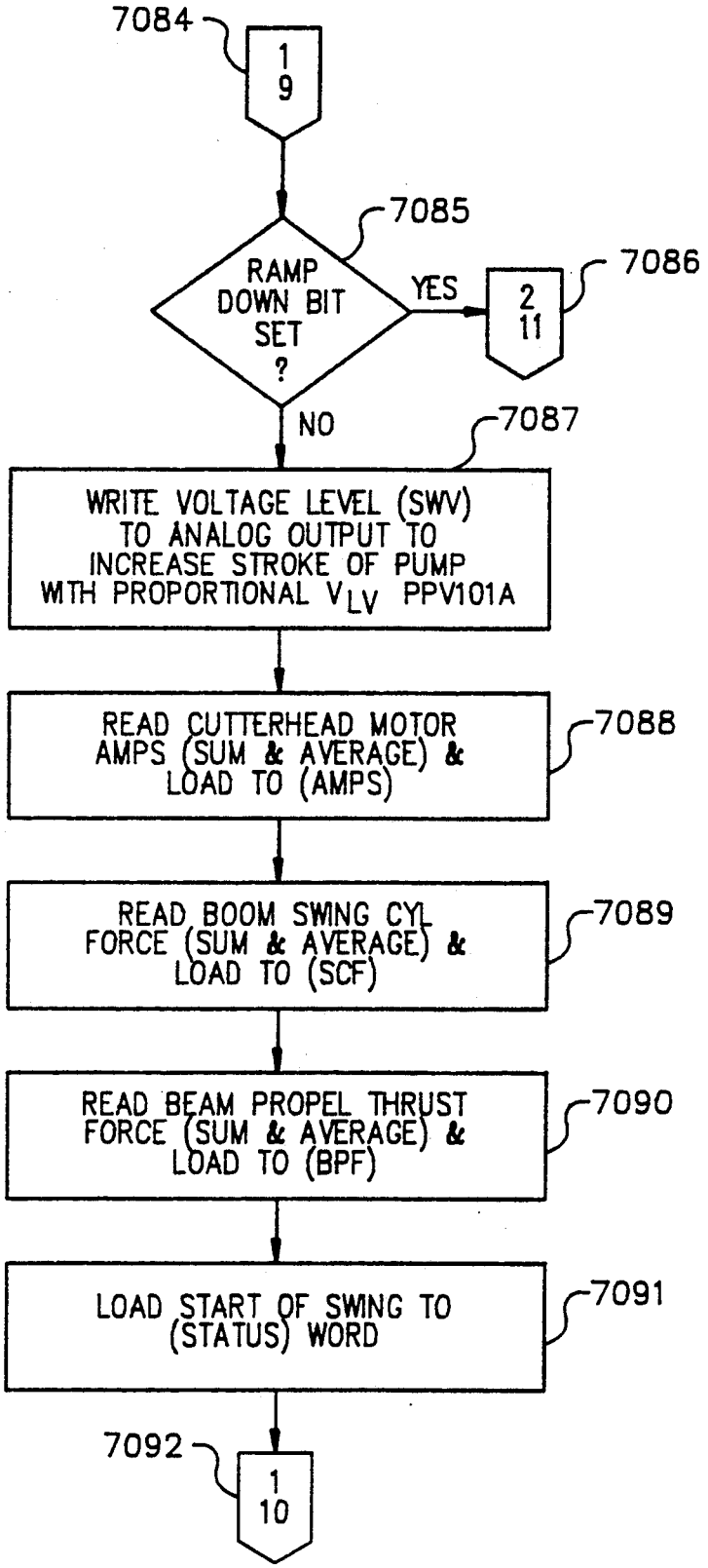
Figure 7J:
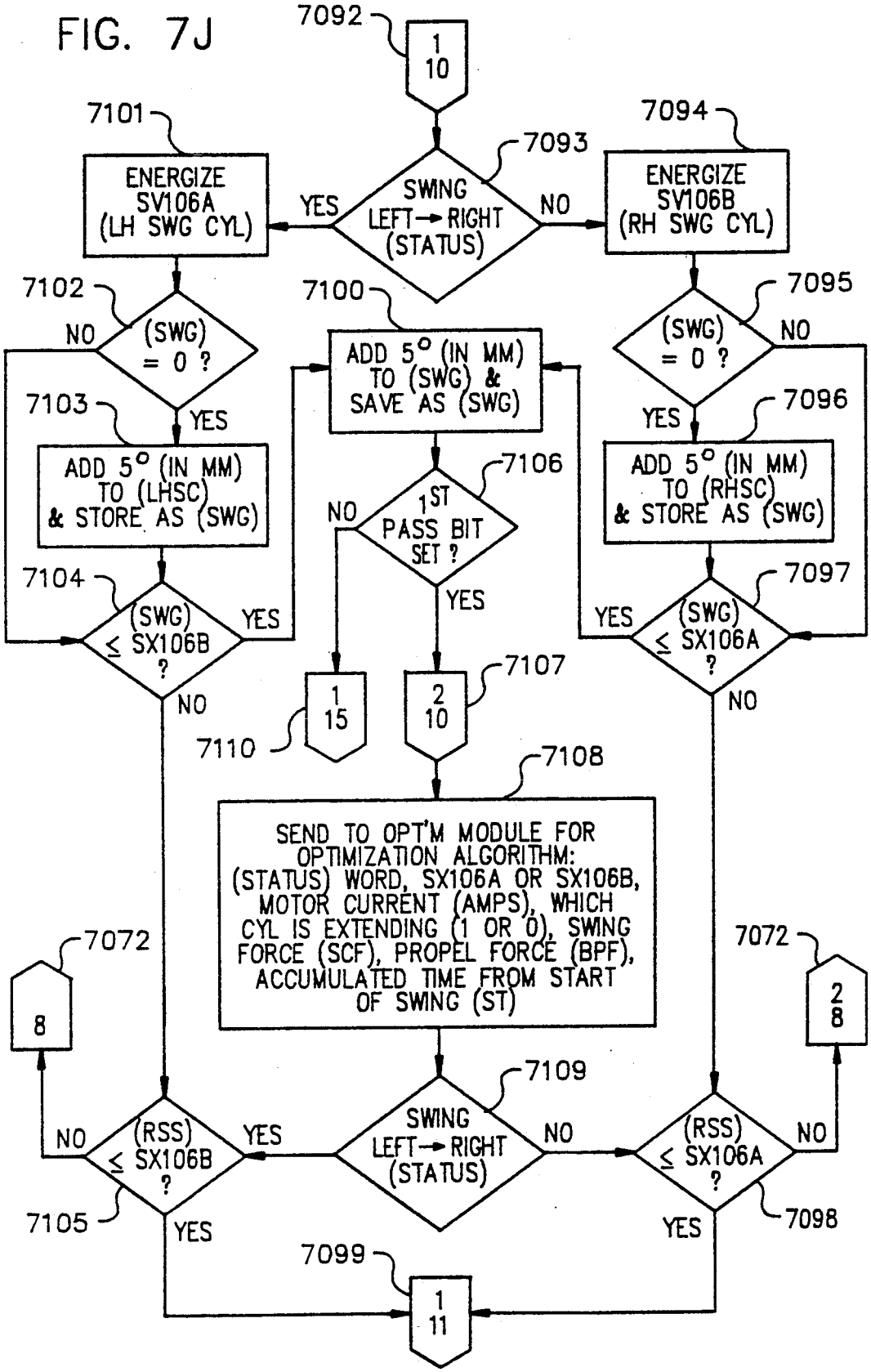
Figure 7K:
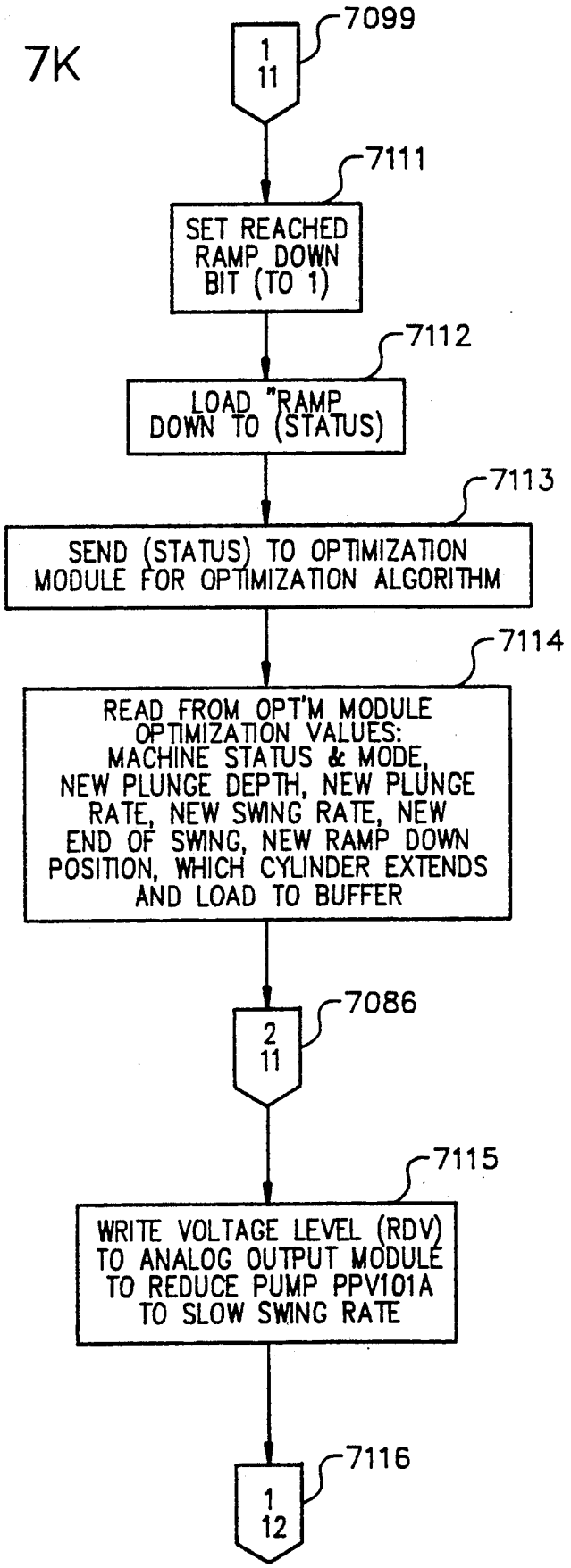
Figure 7L:
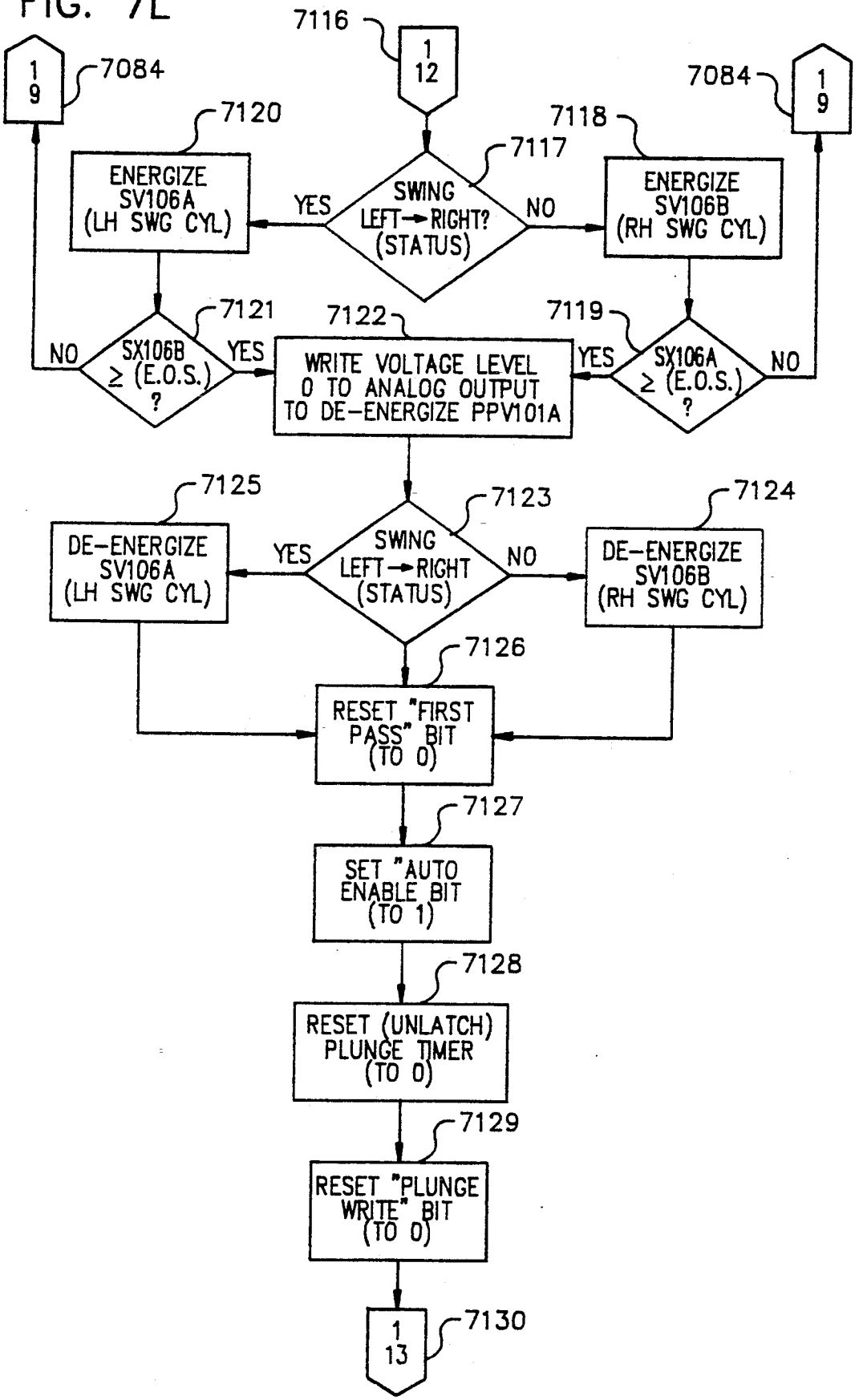
Figure 7M:
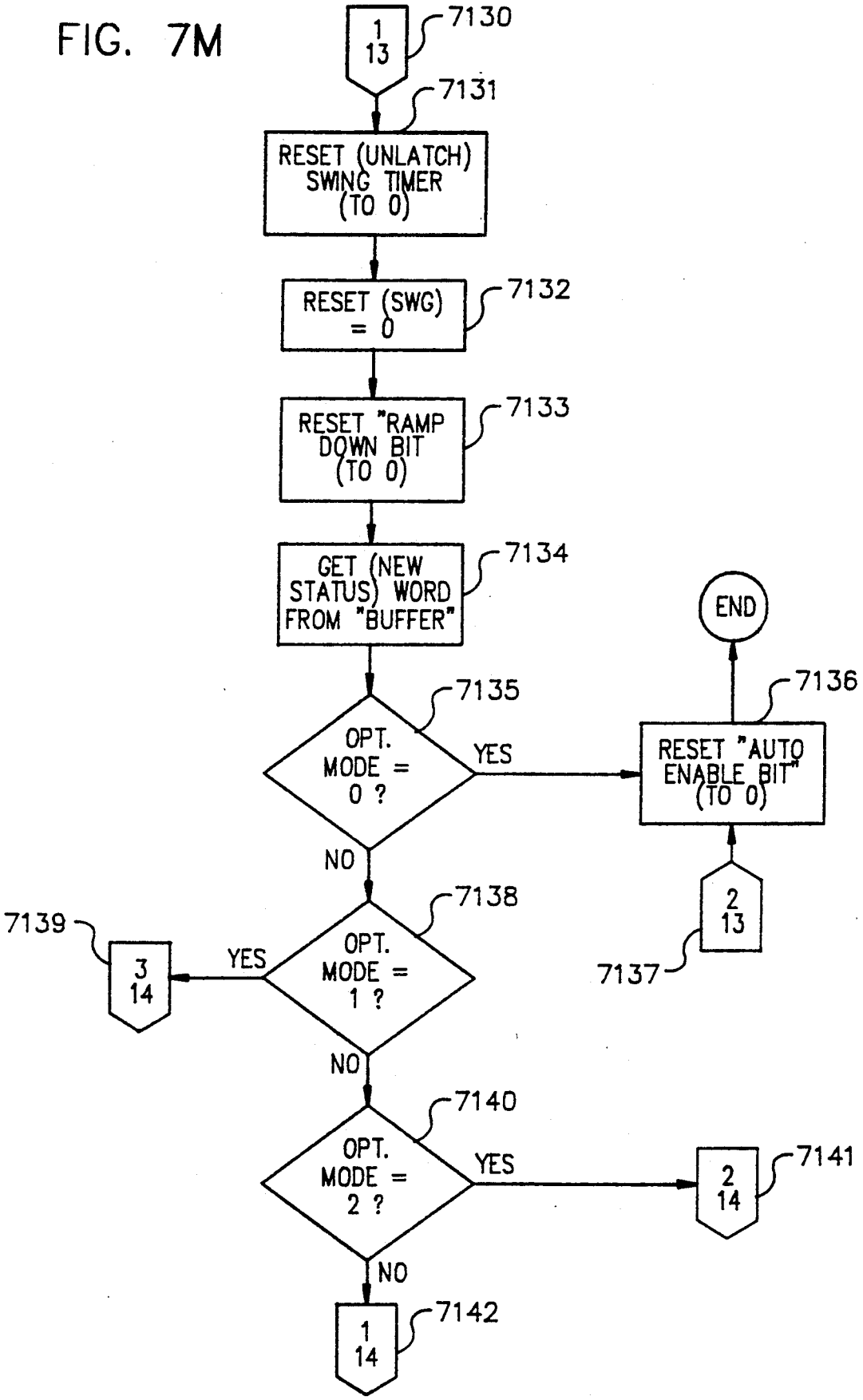
Figure 7N:
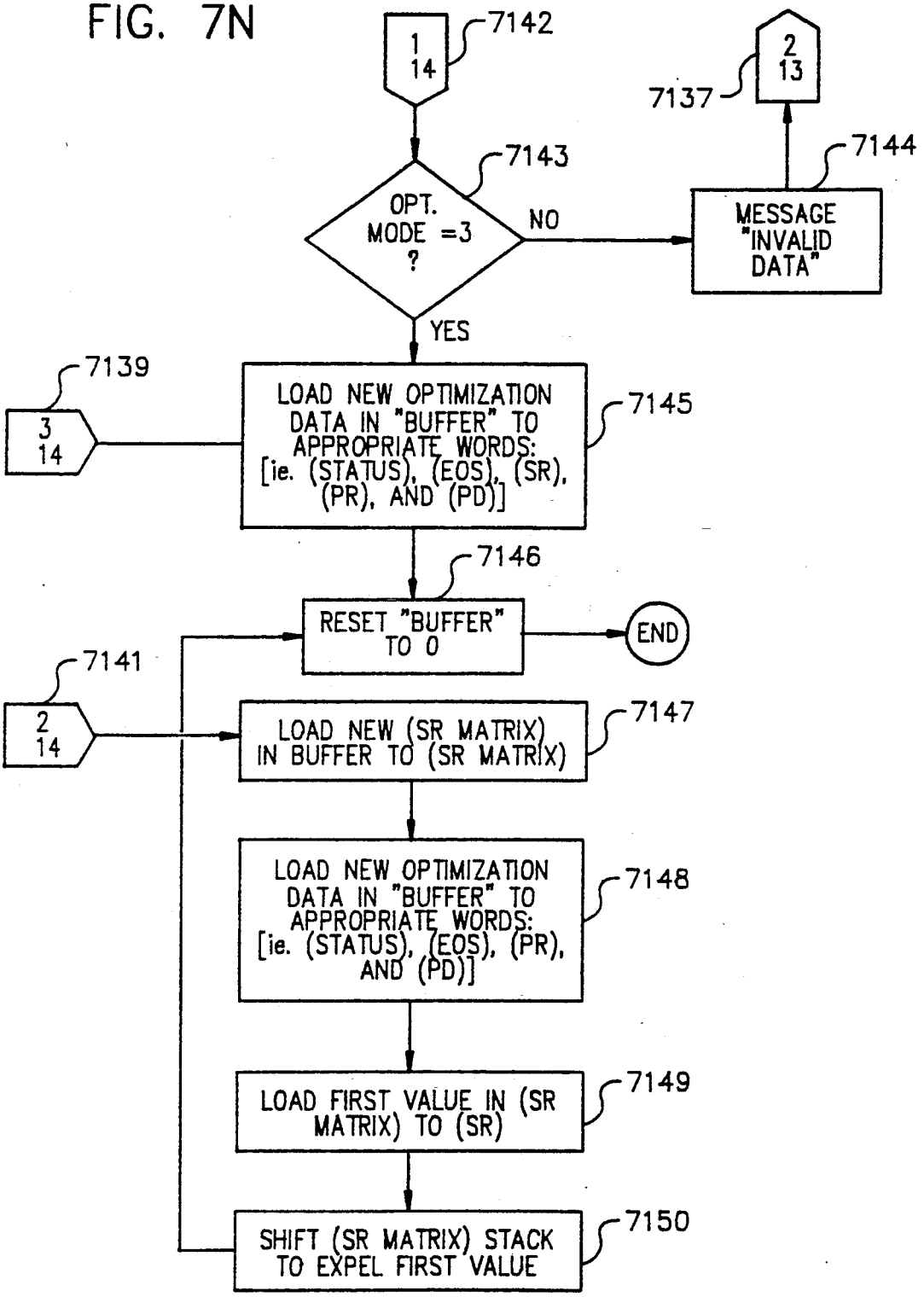
Figure 70:
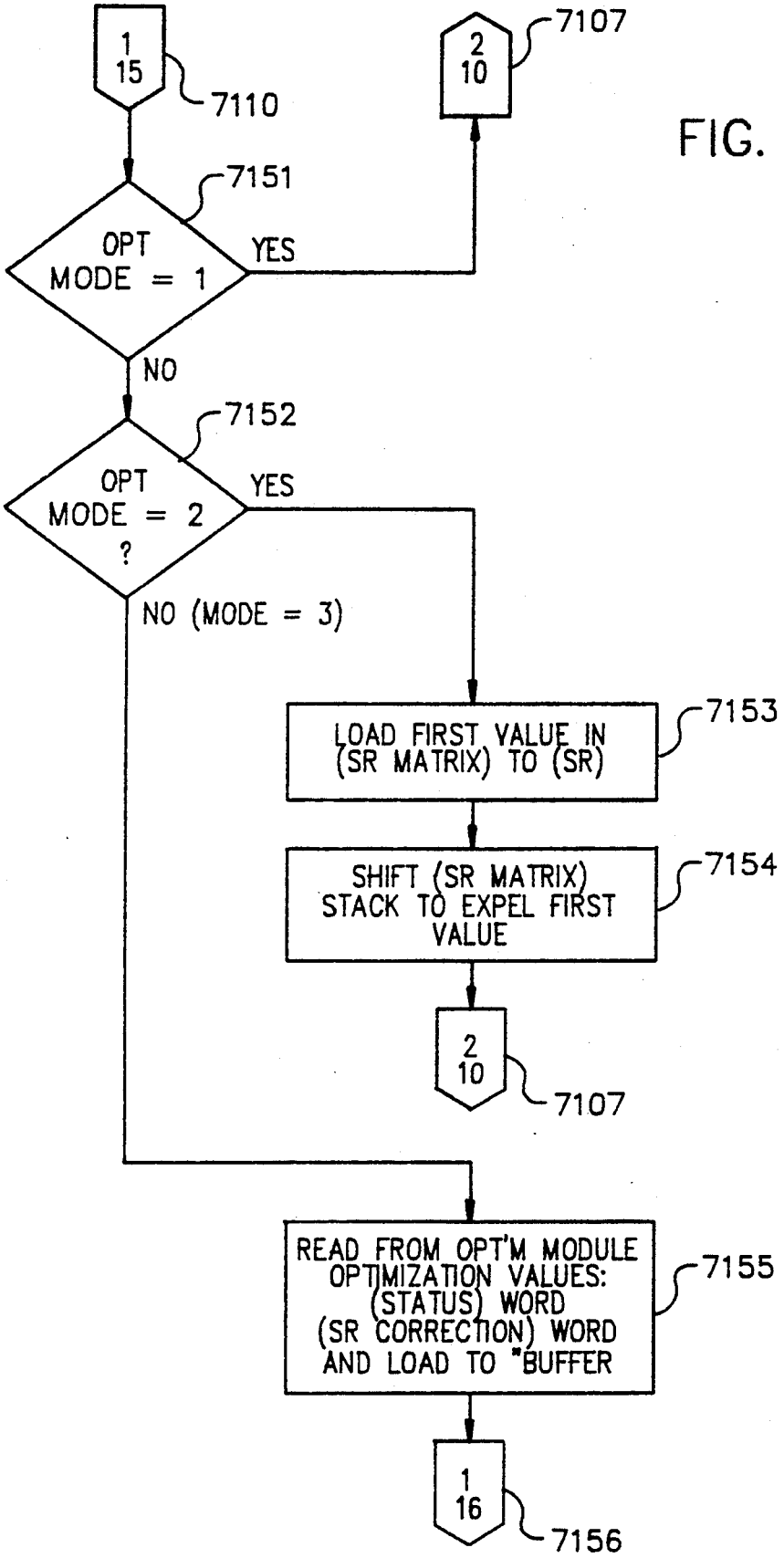
Figure 7P:
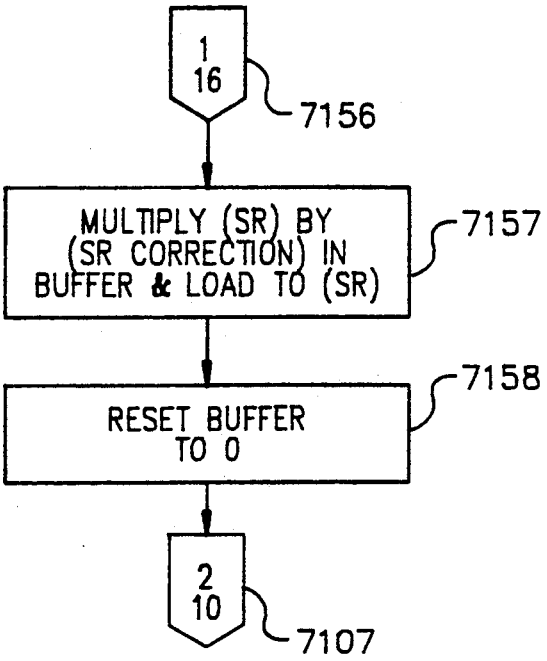

Now described is PLC program 7000 of FIGS. 7A–7P, this program controls the functioning of processor 85.

Referring first to block 7001, at this block certain preexisting conditions must be met before the program is initiated. Specifically, the cutterhead motors must be running, all the safety circuits of the machine must be satisfied, the survey data should be entered, the steering data must be entered, and the tunnel width or the face width must be entered. Also, based on the above conditions, the end-of-swing cylinder extensions will be calculated by another program.

Next, at block 7002, processor 85 is programmed to run the program 7000. At block 7003, the right hand swing cylinder extension is compared to the end-of-swing that was previously calculated. Block 7004 is a decision block at which it is ascertained whether or not the right hand cylinder extension is greater than or equal to end-of-swing. If the answer is "yes", the program proceeds to block 7005 at which the left hand swing cylinder extension data taken from the transducer is loaded to a file. Next, at block 7006, a bit indicating the program is reading the left hand cylinder extension is set at 0 in the status word. The program next proceeds to block 7007 which is label 1-2. From Label 1-2 the program then proceeds to block 7013 to be described in further detail below.

Now referring again to block 7004, a decision block, if the answer is in the negative, the program proceeds to block 7008 at which the left hand swing cylinder extension is compared to the end-of-swing. Block 7009 is a decision block at which it is ascertained whether the left hand cylinder extension is greater than or equal to the end-of-swing. If the answer is "no", the program proceeds to block 7010. At block 7010, the operator is prompted with the message "condition the face". From block 7010, the program proceeds to an end-of-program designation where the program then preferably proceeds to an alarm and warning subroutine, either proprietary or known in the art. From the alarm and warning subroutine, the program then loops to the start of the main program, controlling PLC program 7000.

Referring again to decision block 7009, if, on the other hand, the answer is "yes", the program proceeds to block 7011. At block 7011, the right hand swing cylinder extension data is sent to a file. Next, at block 7012, a bit is set in the status word indicating that the program is reading the right hand cylinder extension. From block 7012, the program proceeds to block 7007, which is label 1-2 described above. From block 7007, the program proceeds to block 7013 where it is determined whether the auto-enable bit is equal to 1. If the answer is "yes", the program proceeds to block 7014, which is label 1-4. From block 7014, the program proceeds to block 7045 to be described in further detail below.

Again referring to decision block 7013, if the decision is "no", the program proceeds to 7015 where the data from the previous swing is stored. Next the program proceeds to block 7016 at which the operator is shown the data retrieved from the previous swing. Block 7017 is a decision block at which the operator decides whether or not to choose current data. If the answer is "yes", the program proceeds to block 7018. Block 7018 is a decision block at which the operator decides whether or not to enter 1. If the decision is "no", the program proceeds to the end designation previously described. If, on the other hand, the answer at block 7018 is "yes", the program proceeds to block 7019, which is label 2-3. From label 2-3, the program then proceeds to block 7042 to be described in further detail below.

Referring again to decision block 7017, if, on the other hand, the decision is "no", the program proceeds to decision block 7020. Block 7020 is a decision block at which the operator later decides whether to enter 0. If the operator does not enter 0, i.e., if the decision is "no", the program proceeds to the end of program designation, as previously described above. If, on the other hand, the operator does enter 0, i.e., the decision is "yes", the program proceeds to block 7021. Block 7021 prompts the operator with the message "enter swing rate".

Block 7022 is a decision block at which it is ascertained whether the operator has entered the swing rate. If the answer is "no", the program proceeds to the end of program designation as described above. If, on the other hand, the answer is "yes", the program proceeds to decision block 7023. Decision block 7023 ascertains whether the swing rate chosen is within the machine limits. If the answer is in the negative, the program proceeds to block 7024 at which the program prompts the message "invalid data" to the operator. At block 7024, the program then proceeds back to block 7021 described above.

Referring again to block 7023, if, on the other hand, the answer is "yes", the program proceeds to block 7025. At block 7025, the swing rate chosen is loaded into memory. Block 7026 prompts the operator with the message "enter plunge rate". The program then continues to block 7027, which is a decision block.

Block 7027 determines whether the operator has entered the plunge rate. If the answer is "no", the program continues to the end designation as described above. If, on the other hand, the decision was "yes", the program continues to block 7028, which is a decision block. Block 7028 determines whether the rate chosen was within the machine limits. If the answer is "no", the program proceeds to block 7029. Block 7029 prompts the operator with the message "invalid data". The program then proceeds to block 7026 described previously.

Referring back to block 7028, a decision block, if the answer is "yes", the program proceeds to label 1-3 which is block 7030. The program continues from label 1-3 or block 7030 to block 7031. Block 7031 loads the chosen plunge rate into memory. Block 7032 prompts the operator with the message "enter plunge depth".

The program then proceeds to block 7033, which is a decision block. Block 7033 determines whether the operator has entered the plunge depth. If the answer is "no", the program continues to the end designation as previously described above. If the answer from block 7033 is "yes", the program proceeds to block 7034, a decision block.

Block 7034 determines whether the plunge depth is within the machine limits. If the answer is "no", the program proceeds to block 7035. Block 7035 prompts the operator with the message "invalid data". The program then proceeds to block 7032 previously described.

If the answer from the decision made in block 7034 is "yes", the program proceeds to block 7036, "load plunge depth". Block 7037 prompts the operator with the message "enter optimization code".

The program then proceeds to block 7038, a decision block. Block 7038 determines whether the operator has entered the optimization code. If the answer is "no", the program proceeds to the end of program designation as previously described above.

If the answer to decision block 7038 is "yes", the program proceeds to block 7039, a decision block. Block 7039 determines whether the operator has entered a valid optimization code. The valid numbers are 0, 1, 2, or 3. Optimization code 0 indicates that the program will bypass the optimization program 8000 and run strictly off of operator input. Optimization codes 1, 2 and 3, pertain to mode 1, mode 2 and mode 3 of operation, respectively.

If the answer to decision block 7039 is "no", the program continues to block 7040. Block 7040 prompts the operator with the message "invalid code". The program then continues to block 7037 previously described above.

If, on the other hand, the answer to decision block 7039 is "yes", the program proceeds to block 7041. Block 7041 loads the previously chosen optimization code to the status word. The program then continues to block 7042. Block 7042 displays the message "data OK, press start". Block 7042 is also in the path of the program coming from label 2-3 which is block 7019 previously described. The program then continues to block 7043, which is a decision block. Block 7043 determines whether the start button has been pressed. If the answer to the decision in block 7043 is "no", the program continues to the end designation as previously described above. If the answer, on the other hand, is "yes", the program proceeds to block 7044.

Block 7044 sets the "first pass bit" to "1". The program then continues to label 1-4, which is block 7014 previously described. The program continues from block 7014 to block 7045. Block 7045 reads the upper right propel cylinder extension and loads it to memory.

The program continues to block 7046, which reads the lower left propel cylinder extension and loads it to memory. Block 7047 subtracts the upper right propel cylinder extension from the maximum propel cylinder extension distance determined by the physical length of the propel cylinder. The program continues to block 7048, a decision block.

Block 7048 ascertains if the difference between the upper right propel cylinder extension and the maximum propel cylinder extension is greater than the plunge depth entered above. If the answer to this question is "no", the program continues to block 7049. Block 7049 prompts the operator with the message "regrip required". Block 7050 resets the "first pass" and the "auto-enable" bits to "0". From block 7050, the program goes to the end of program designation as previously described above.

If the answer to the decision in block 7048 is "yes", the program proceeds to block 7051. Block 7051 subtracts the lower left propel cylinder extension from the maximum propel cylinder extension determined by the physical length of the cylinder. The program continues from block 7051 to block 7052, a decision block. Block 7052 ascertains if the difference derived in block 7051 is greater than the plunge depth. If the answer to this decision is "no", the program proceeds to block 7049 previously described.

If the answer to decision block 7052 is "yes", the program proceeds to label 1-5, which is block 7053. The program continues from label 1-5 or block 7053, to block 7054. Block 7054 adds the plunge depth to the right propel cylinder extension and stores this new value to memory. Block 7055 adds the plunge depth to the left propel cylinder extension and stores this new number to memory. Block 7056 calculates the output voltage to the propel cylinder proportional valve and the time that the signals will be present at the valve. This is calculated from the relationship of the plunge depth and plunge rate to the valve, operational amplifier, and cylinder characteristics, plus a correction factor derived from the actual extension and the desired extension.

Block 7057 loads the output voltage determined in block 7056 to memory. It also loads the time, also calculated in block 7056 to memory. The program continues to label 2-5, which is block 7058.

The program then continues to block 7059, a decision block. Block 7059 ascertains if the plunge timer has been set. If the answer to this question is "no", the program proceeds to block 7060. Block 7060 starts a timer known as the "plunge timer". The plunge timer accumulates time until the plunge cycle is complete. The program continues from block 7060 to label 2-5 which is block 7058 previously described.

If the answer to the decision block 7059 is "yes", the program proceeds to block 7061, a decision block. Block 7061 determines if the time calculated in block 7056 is greater than or equal to the accumulated time from the plunge timer. If the answer to this decision is "no", the program proceeds to label 1-6, which is block 7064. Block 7065 obtains the voltage level determined in block 7056 and sends it to the analog output module to energize the propel cylinder proportional valve.

Block 7066 reads and averages the cutterhead motor amperage and loads this to memory. Block 7067 reads and averages the boom swing cylinder force and loads this to memory. Block 7068 reads and averages the beam propel thrust force and loads this to memory. The program then continues to label 2-5, which is block 7058, previously described.

If the decision required from block 7061 is "yes", the program continues at block 7063, which is a label identified 2-6. The program continues from label 26, or block 7063, to block 7069. Block 7069 sends a voltage level of 0 to analog output module thereby de-energizing the propel cylinder proportional valve. The program continues from block 7069 to label 1-7, which is block 7070. The program continues from block 7070 to block 7071, a decision block.

Decision block 7071 determines if the "plunge write" bit has been set to "1". If the answer to the decision in block 7071 is "no", the program proceeds to block 7073. Block 7073 reads the present position for the upper right hand propel cylinder and subtracts the previous right hand propel cylinder extension distance and loads this new number which is the actual plunge depth for the right hand propel cylinder in memory. Block 7074 reads the actual value of the lower left hand propel cylinder and subtracts the previous position of the lower left hand propel cylinder and loads this new number which is the actual plunge depth for the left hand cylinder into memory. Block 7075 compares the actual plunge depth to the programmed plunge depth and calculates a new correction to be used in the next plunge. Block 7076 sends a block of information to the optimization module 87 for use in the optimization program 8000. This information consists of the machine status word, the true plunge depth, the cutterhead amperage, a bit signifying whether the left or right hand swing cylinder is extended, and the tip ration. The tip ratio is a cutter wear factor that is derived from empirical data. Also included in this packet of information is the left hand and right hand swing cylinder extension values. The program continues from block 7076 to label 1-8, which is block 7077. From block 7077, the program goes to block 7062. Block 7062 sets the "plunge write" bit to "1". The program continues from block 7062 to label 1-7, which is block 7070, previously described.

If the answer to decision block 7071 is "yes", the program continues to label 2-8, which is block 7072. The program goes from block 7072 to block 7078. Block 7078 calculates the output voltage determining the swing rate which will be sent to the swing pump proportional control valve. This is determined from relationships of the valve operational amplifier and cylinder characteristics, and a correction factor derived from empirical data. This output voltage value is then stored to memory.

The program continues from block 7078 to block 7079, a decision block. Block 7079 ascertains if the first pass bit has been set to "1". If the answer to this decision is "yes", the program continues to block 7080. Block 7080 calculates at what point during the swing the swing speed should be reduced to an extremely slow swing rate. This point typically occurs near the end of the swing cycle. The program continues from block 7080 to label 3-8, which is block 7081. The program continues from block 7081 to block 7082, a decision block which is described below.

Returning to block 7079, a decision block, if the decision reached in this block is "no", the program continues to label 3-8, which is block 7081 previously described. Block 7082, a decision block, determines if the "swing timer" has been turned on. If this answer to the decision is "no", the program continues to block 7083. Block 7083 turns on the swing timer. The program then continues from this block to label 3-8, which is block 7081, previously described.

If the answer to the decision in block 7082 is "yes", the program continues to label 1-9, which is block 7084. From block 7084, the program continues to block 7085, a decision block. Block 7085 ascertains if the "ramp down bit" has been set to "1". If the answer to the decision in block 7085 is "yes", the program continues to block 7086, a label identified as 2-11. From label 2-11 or block 7086, the program continues to block 7115, which will be described below.

If, on the other hand, the decision at block 7085 is "no", the program continues to block 7087. Block 7087 writes the voltage level determined in block 7078 above to the proportional control valve which controls the swing pump. Block 7088 reads and averages the cutterhead motor amps and stores these in memory. Block 7089 reads and averages the boom swing cylinder force and stores this number in memory. Block 7090 reads and averages the beam propel thrust force and stores this value to memory. Block 7091 loads a bit to the status word to indicate the start of the swing cycle. The program continues from block 7091 to label 1-10, which is block 7092. The program continues from label 1-10, block 7092, to block 7093, a decision block.

Block 7093 ascertains if the swing is going from the left to the right. This information was loaded into the status word in block 7006 or in block 7012 previously described. If the answer to this decision is in the affirmative, i.e., "yes", the program continues to block 7101. Block 7101 energizes the left hand swing cylinder solenoid valve and causes the cylinder to extend. The program then continues to block 7102, a decision block. The decision block 7102 ascertains if the memory word, which for the purposes of clarity will be referred to as "SWG", has a value of "0". If the answer to this decision is "yes", the program continues to block 7103. Block 7103 gets the left hand cylinder extension distance that was saved to memory in block 7008 previously described and adds to it a swing cylinder extension distance of approximately 5° in millimeters. This new value is then saved as "SWG". The program then continues to block 7104 to be described below.

If, on the other hand, the decision reached at block 7102 is "no", the program proceeds directly to decision block 7104. Decision block 7104 ascertains if the value in the register "SWG" is less than or equal to the actual left hand swing cylinder extension. If the answer to this decision is "no", the program then proceeds to decision block 7105 to be described below. If the answer to decision block 7104 is "yes", the program continues at block 7100 to be described below.

Returning to decision block 7093, if the answer to this block is "no", the program proceeds to block 7094. Block 7094 causes the right hand swing cylinder solenoid valve to energize, thereby extending the right hand swing cylinder. The program continues to block 7095, a decision block.

Decision block 7095 ascertains if a memory word, which for the purpose of clarity will be referred to as "SWG", has a value of "0". If the answer to this decision is "yes", the program continues to block 7096. Block 7096 gets the right hand cylinder position word stored in memory at block 7011 previously described and adds to it a swing cylinder extension distance of 5° in millimeters. This new value is then stored in memory as word "SWG". The program then continues to block 7097, a decision block to be described below.

Returning to decision block 7095, if the answer to this question is "no", the program continues directly to block 7097, a decision block. Block 7097 ascertains if the value in the word "SWG" is less than or equal to the right hand swing cylinder extension. If the answer to this decision is "no", the program continues to block 7098, a decision block to be described below. If, on the other hand, the answer is "yes", the program continues to block 7100. Block 7100 takes the value in the word "SWG" and adds to it a swing cylinder extension of 5° in millimeters. This new value is then saved to the register "SWG". The program then continues to block 7106, a decision block. Decision block 7106 determines if the "first pass" is set to "1". If the answer to this question is "yes", the program proceeds to label 2-10, which is block 7107. From block 7107, the program proceeds to block 7108. Block 7108 sends to the optimization module 87 for use in the optimization program 8000 the machine status word which also contains the information on which cylinder is extending, the actual extension value of the extending swing cylinder, the swing cylinder force described in block 7067 above, the beam propel thrust force described in block 7068 above, the accumulated average of the motor current amps, and the accumulated time from the start of the swing established from turning on the timer indicated in block 7083.

The program then continues to block 7109, a decision block. The decision block 7109 ascertains if the swing is traveling from the left to the right. If the answer to this decision is "yes", the program proceeds to decision block 7105. The decision block 7105 determines if the ramp down point determined in block 7080 above is less than or equal to the left hand swing cylinder extension. If the answer to this decision is "no", the program proceeds to label 2-8, which is block 7072 previously described. If, on the other hand, the answer to this decision is "yes", the program proceeds to label 1-11, which is block 7099. The program proceeds from block 7099 to block 7111, which will be described below.

Returning to decision block 7109, if the decision from this block is "no", the program continues to decision block 7098. Decision block 7098 determines if the ramp down point determined in block 7080 is less than or equal to the right hand swing cylinder extension. If the decision from this block is "no", the program proceeds to block 7072, which is labeled 2-8, described above. If, on the other hand, the decision reached at block 7098 is "yes", the program proceeds to label 1-11, which is block 7099. The program continues from label 1-11 or block 7099 to block 7111, which will be described below.

Returning to the decision block 7106, if the answer to this block is "no", the program then continues to label 1-15, which is block 7110. Continuing from block 7110, the program goes to block 7151, a decision block. This block determines if the "optimization mode" is equal to "1". If the answer to this questions is "yes", the program proceeds to label 2-10, which is block 7107 previously described. If, on the other hand, the answer to this decision is "no", the program continues to block 7152, a decision block. This decision block determines if the "optimization mode" is equal to "2". If the answer is in the affirmative, the program proceeds to block 7153. Block 7153 moves the first value in the swing rate matrix, which is loaded into memory elsewhere in this program, to the swing rate memory word which is established in block 7025 described above. Block 7154 then shifts the swing rate matrix stack up one position to expel the first value which was used in block 7153 above. The program then continues to label 2-10, which is block 7107 described previously.

Returning to decision block 7152, if the answer to the question posed in this block is "no", it indicates that the "optimization mode" chosen is "mode 3". This causes the program to continue at block 7155. Block 7155 reads the machine status word and the swing rate correction word from the optimization module 87 derived by optimization program 8000 and loads these to a memory buffer. The program then continues at label 1-16 which is block 7156. From block 7156, the program continues to block 7157.

At block 7157, the existing swing rate is multiplied by a swing rate correction factor that has been loaded in the buffer and this new value is then loaded to the swing rate word in memory. Block 7158 resets the buffer to 0. The program continues at label 2-10, which is block 7107 described previously. Block 7111, which was mentioned previously but not described, sets the reached ramp down bit to "1".

The program then continues at block 7112, which loads the "reached ramp down" bit to the "status" word. Block 7113 then sends the "status" word to the optimization module 87 for use in the optimization program 8000. Block 7114 causes the program to read optimization values derived in the optimization program 8000 and sent from the optimization module 87. The information read includes the machine status and mode data, the new plunge depth, the new plunge rate, the new swing rate, the new end-of-swing position, the new ramp down position, and which cylinder is going to extend. This information is then loaded to a memory buffer.

The program then continues to label 2-11 which is block 7086 described above and is in the path from decision block 7085, also described above. The program goes from block 7086 to block 7115. Block 7115 sends a reduced voltage level to the analog output module controlling the swing rate pump proportional control valve, which in turn causes the pump to produce a reduced oil flow for a reduced swing rate. The program then continues to label 1-12, which is block 7116. From block 7116, the program continues to block 7117, which is a decision block.

The decision block 7117 determines if the swing is traveling from left to right. If the answer to this decision is "yes", the program proceeds to block 7120. Block 7120 causes the left hand swing cylinder solenoid to remain energized. The program then continues to decision block 7121. Block 7121 ascertains if the left hand swing cylinder extension distance is greater than or equal the end-of-swing value previously loaded into memory. The end-of-swing value determines the turnaround point of the swing cycle. If the answer to this decision is "no", the program proceeds to label 1-9, which is block 7084 described previously. If, on the other hand, the answer to this decision is "yes", the program continues to block 7122, which will be described below.

Returning to decision block 7117, if the answer to this question is "no", the program continues to block 7118. Block 7118 keeps the right hand swing cylinder solenoid valve energized. The program then continues to decision block 7119. This block ascertains if the right hand swing cylinder extension is greater than or equal to the end-of-swing value previously loaded in memory. If the answer to this decision is "no", the program proceeds to label 1-9, which is box 7084 described previously. If, on the other hand, the answer to this decision is "yes", the program continues to block 7122. Block 7122 writes a voltage level of "0" to the analog output module supplying power to the proportional control valve controlling the swing rate pump thereby bringing the pump to 0 stroke and stopping the flow of oil. The program then continues to decision block 7123.

Decision block 7123 again determines if the swing is from left to right. If the answer to this question is "yes", the program proceeds to block 7125. Block 7125 then causes the left hand swing cylinder solenoid valve to de-energize, thereby stopping the flow of oil to the swing rate pump. The program then continues to block 7126 to be described below.

If the choice at block 7123 was "no", the program continues to block 7124. Block 7124 de-energizes the right hand swing cylinder solenoid valve, thereby stopping the flow of oil to the right hand swing cylinder. The program then continues to block 7126. Block 7126 resets the first pass bit to "0". Block 7127 sets the auto-enable bit to "1". Block 7128 resets the plunge timer accumulated value to "0". Block 7129 resets the plunge write bit to "0". The program then continues at label 1-13, which is block 7130. The program continues from block 7130 to block 7131. Block 7131 resets the swing timer accumulated value to "0". Block 7132 clears the word "SWG" and sets it to "0". Block 7133 resets the ramp down bit to "0". Block 7134 obtains the new status word, which was loaded in the buffer memory earlier in the program, and makes it available for the decision blocks to follow. The program then continues to decision block 7135.

Decision block 7135 ascertains if the optimization mode in the new status word is equal to "0". If the answer to this decision is "yes", the program proceeds to block 7136. Block 7136 resets the auto-enable bit to "0". The program then continues to the end of program designation as previously described above.

If the answer to the decision on block 7135 is "no", the program proceeds to block 7138, a decision block. Block 7138 ascertains if the optimization mode from the new status word loaded above equals "1". If the answer to this decision is "yes", the program proceeds to label 3-14, which is block 7139. Continuing from block 7139, the program goes to block 7145, to be described below.

If, on the other hand, the decision reached at block 7138 is "no", the program continues to block 7140, a decision block. Block 7140 ascertains if the "optimization mode" from the new status word loaded above is equal to "2". If the decision reached is "yes", the program continues to label 2-14, which is block 7141. Continuing from block 7141, the program goes to block 7147 to be described below. If, on the other hand, the decision reached at block 7140 is "no", the program continues to label 1-14, which is block 7142. The program continues from block 7142 to block 7143, which is a decision block.

Decision block 7143 ascertains if the "optimization mode" from the new status word loaded above is equal to "3". If the answer in this case should be "no", the program goes to block 7144. Block 7144 prompts the operator with the message "invalid data". The program then continues to label 2-13, which is block 7137. From block 7137, the program continues to block 7136, which was previously described. If, on the other hand, the decision reached at block 7143 is "yes", the program goes to block 7145. Block 7145 moves the new data that was stored in the buffer to the appropriate memory words, i.e., machine status, end-of-swing, swing rate, plunge rate, and plunge depth. The program then continues to block 7146. Block 7146 resets the buffer used to "0". The program continues from here to the end of program designation as previously described above.

Label 2-14, which is block 7141, previously described, sends the program to block 7147 mentioned earlier but not described. Block 7147 moves the new swing rate matrix that was loaded in the buffer to a location in memory. Block 7148 moves the new optimization data, which came from optimization program 8000 earlier and was stored in the buffer to the appropriate storage words, i.e., machine status, end-of-swing, plunge rate, and plunge depth. Block 7149 moves the first value in the swing rate matrix to the swing rate word in memory. Block 7150 shifts the swing rate matrix stack in memory to expel the first value which was used in block 7149 above. The program then continues from block 7150 to block 7146 described earlier.

Figure 8A:
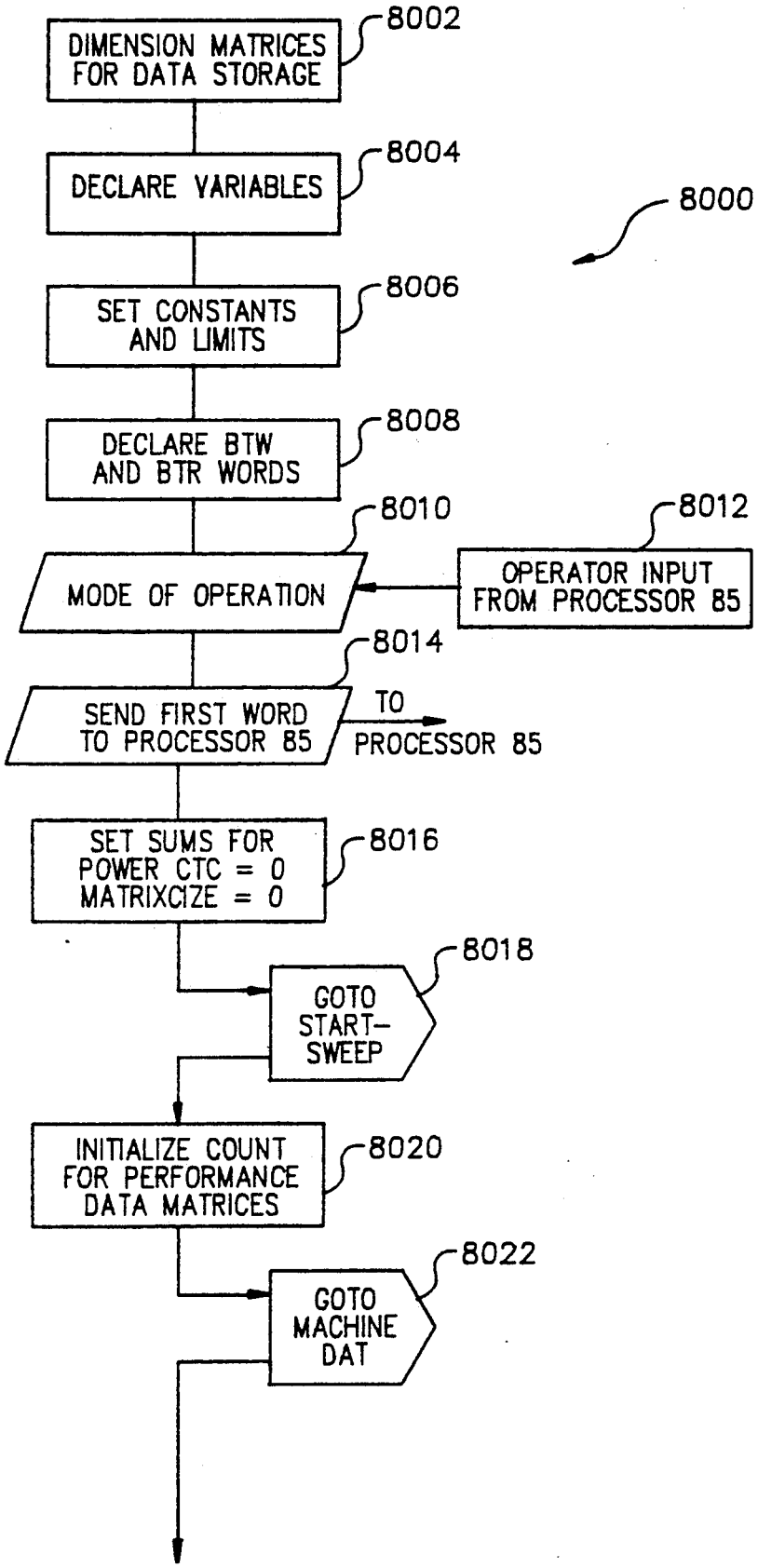
FIGS. 8A–8B is a flow chart of the optimization program.
Figure 8B:
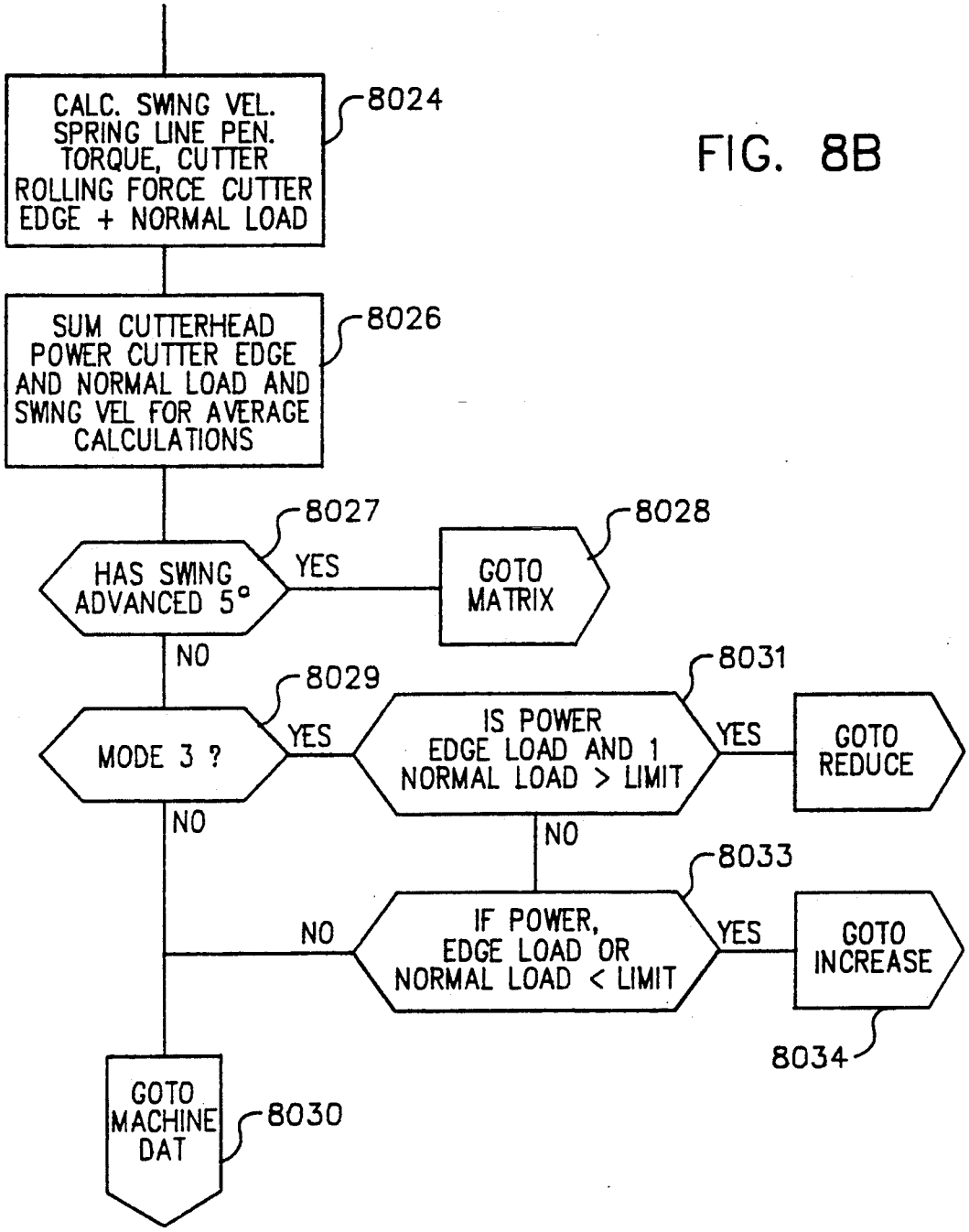

Referring to the optimizing program 8000 of FIGS. 8A–8B, the program is a driver program that calls subroutines as required. The subroutines are detailed in FIGS. 9–16, below. Referring to block 8002 of FIG. 8 entitled "dimension matrices for data storage", five matrices are dimensioned. These matrices are for: storing values of cutterhead power, slewing velocity, cutter normal load, cutter edge load, and calculated slew velocities for the next swing. In the initial program values will be entered into the performance matrices every 5° of swing. Block 8004 is entitled "declare variables". The variables that will be used in the program are all declared at the beginning of the program for smoother operation. The variables declared are the following.

True plunge—actual machine plunge at the beginning of a slew

Cutter tip ratio—describes cutter dullness

Machine status—is the machine slewing, stopped

Extension cylinder status—cylinder for extension data

Swing cylinder extension

Calculated swing velocity

Average cutterhead motor amperage—from Processor 85

Time between transmissions of data from Processor 85

Program status—status of optimization program

Calculated swing angle

Average cutter edge load during swing

Average cutterhead power during swing

Average swing velocity during swing

Average cutter normal load during swing

Operation mode (Mode 1, 2, or 3)

Sum for cutterhead power—for 5 degree averages

Sum for normal load—for 5 degree averages

Sum for edge load—for 5 degree averages

Sum for swing rate—for 5 degree averages

Calculated cutterhead power

Calculated cutterhead torque

Calculated cutter tangential force

Max. cutter penetration at springline

Calculated cutter edge load

Calculated cutter normal load

Max. swing angle at the wall

Correction status—tells processor 85 that a swing rate correction will be made

Percent swing rate correction.

The first variable is the true plunge, which is the actual plunge that the machine has taken at the beginning of each swing.

Referring now to block 8006, "declare constants and limits", at this block constants are declared. These include: Pi (3.14159), the conversion between degrees and radians, the cutterhead RPM (this value can also be inputted into the program as a variable), the cutterhead diameter, the cutter normal load limit, the cutter diameter, the cutter edge load limit (the maximum line load that can be tolerated on the cutter flanges or cutter wing tips), the cutterhead power limit, the maximum slew rate per 4° slew (in degrees per second), the minimum time required per 5° swing, and Kerf spacing at 4° slew. The 4° slew limit is exemplary only.

Referring now to block 8008, "declare words for BTR and BTW", at this block BTR means "block transfer read" and denotes the words that will be passed to the optimization program 8000 from the PLC program 7000 and processor 85. BTW, which is "block transfer write", are the words to be transferred from the optimization program 8000 to the PLC program 7000 and processor 85.

Referring to block 8010, "mode of operation", at this block the operator is allowed to input into the program which operating mode he wishes to work under—mode 1, mode 2, or mode 3. This is also an optional feature. If initially it is decided to only operate in one of these modes, the mode can be set as a constant.

Block 8012, "operator input", optionally allows the operator to input mode selection.

Referring next to block 8014, "send first word" tells the optimization program 8000 to send a word to the PLC program 7000 and processor 85. That word will tell the PLC program 7000 and processor 85 which operating mode is in operation. If mode 3 is in operation, then the PLC program 7000 and processor 85 must read words from the optimization program on a continuous basis throughout the swing. If either mode 1 or mode 2 are employed, the PLC program 7000 and processor 85 will read words from the optimization program only at the end of each swing.

Referring to block 8016, "set sums", this block sets to zero the values which are eventually to become the sums for cutterhead power, cutter normal load, cutter edge load, and swing velocity. This function is always performed at the beginning of each swing. Also set to zero is the initial status of the optimization module 87 and the initial matrix increment (count) value.

Next referring to block 8018, "call startsweep", this block is the initiation of the actual sweep optimization routine. All of the prior blocks pertained to defining constants, declaring variables, setting matrix sizes and setting sums to zero. At block 8018, the optimization program 8000 goes to the startsweep subroutine 9000, to be described in detail later. The startsweep subroutine acquires the initial data from the PLC program 7000 and processor 85. The initial data includes the status of the machine (e.g., if it is operating or not and if it is starting to slew), the initial plunge data (which gives true plunge), the tip ratio (which defines the dullness of the cutters), the swing cylinder extension at the walls, and the swing cylinder that the data is coming from (thus informing the optimization program 8000 if the swing is from left to right or vice versa).

Referring next to block 8020, "initialize counter", at this block two counters are initialized. These include a limit counter for mode 3 and a counter for use in averaging the input data at each 5° interval.

Referring now to block 8022, "call machinedat", at this block, the machinedat subroutine is addressed. This subroutine obtains information from the PLC program 7000 and processor 85 while the cutterhead is slewing across the face. The machinedat subroutine reads words which are passed from the PLC program 7000 and processor 85. These words include the machine status (e.g., if the cutterhead is slewing or if it is starting to ramp down), the swing cylinder extension and the swing cylinder from which data is being obtained, how much time has elapsed between each data transfer (used to calculate the sweep rate), and the cutterhead motor amperage. In addition, if data is to be collected directly from the cutters, the machinedat subroutine will include words which pass the actual monitored cutter normal loads. Machinedat subroutine 11000 itself will be described in further detail below.

Connected to machinedat subroutine 11000 is ramp subroutine 10000. Ramp subroutine 10000 is used to calculate the new plunge and new slew rate to be used during the next slew. The ramp subroutine 10000 is implemented when the PLC program 7000 and processor 85 tells the optimization program 8000 that the machine is at the end of the swing and will be ramping down. At this time, new data is needed for the next swing. The ramp subroutine 10000 is the subroutine which calculates this new data.

Referring now to block 8024, "calculate swing velocity", at this block, while the machine is slewing, the data which is being brought in through the subroutine machinedat 11000 is processed and converted into a number of different values to be used in the final calculations. The values calculated at this time include: The ongoing swing velocity, the swing angle, the maximum penetration of the cutters at spring line, the ongoing cutterhead torque, the average cutter rolling force, the average cutter edge load, and the average cutter normal load.

Referring now to block 8026, at this block the values which have been calculated in the previous block 8024 are then summed for calculations of averages for every 5° interval of swing. For example, as the cutterhead power values come in, a summation is created for the cutterhead power until a 5° slew has occurred. An average power value will then be calculated for this sum. Thus, block 8026 performs summations for the cutterhead power, the cutter normal load, the cutter edge load, and the swing velocity. There is also a counter which counts the number of times a value is added to the summation. When the 5° averages are calculated, the summation are divided by that count value.

At block 8027, it is ascertained whether a 5° slew has occurred.

At block 8028, the matrix subroutine is called. The matrix subroutine is called only at the end of each 5° slew. In the matrix subroutine, the average values for the cutterhead power, cutter normal load, cutter edge load, and slew velocity for each 5° slew are calculated and stored in the performance matrix for each of these values.

After block 8028, the program proceeds to block 8029. Block 8029 ascertains whether the program is operating in mode 3. If the program is not in mode 3, block 8029 goes to block 8030, which returns the program to the machinedat subroutine 8022. If in mode 3, this block 8029 checks the values for the ongoing cutterhead power, cutter edge load, and cutter normal load to see if either they exceed the limits or if they are significantly below these limits. If they exceed the limits then at blocks 8031 and 8032 a reduction in the slewing rate will be made. If they are significantly below the limits, an increase in the slewing rate will be made at blocks 8033 and 8034. Note that mode 3 is essentially a real time mode that adjusts the slewing rate during a slew. This is not true for either mode 1 or mode 2. Slew rate increases for mode 3 are made by then going to subroutine mode 3 increase 10000 described in detail below. Slew rate decreases are made going to subroutine mode 3 reduce 15000 described in detail below. If the cutterhead power, cutter edge load or cutter normal load are not significantly below the limits at block 8033, the program goes to block 8030 described above.

Figure 9:
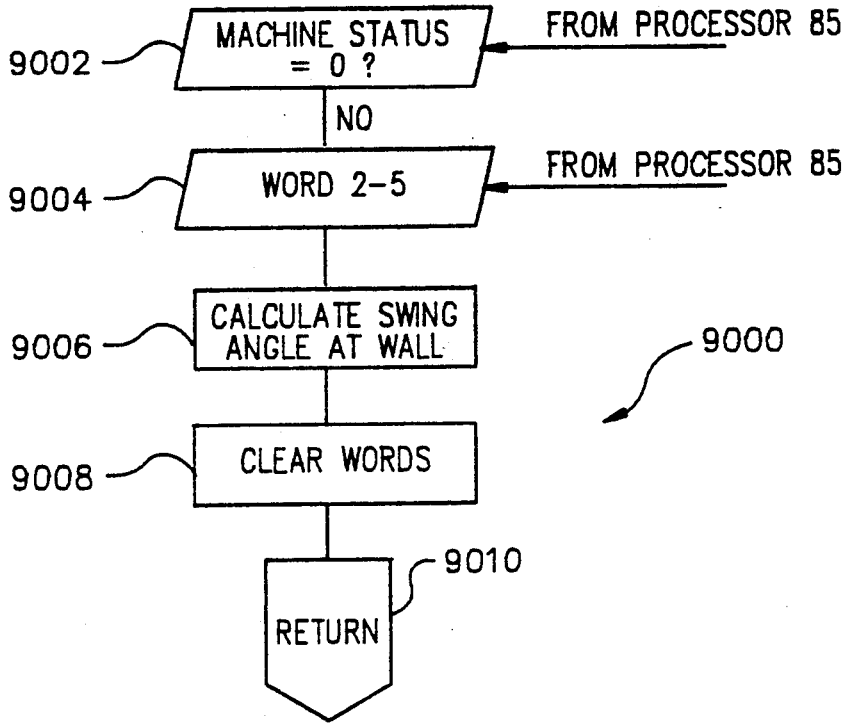
FIG. 9 is a flow chart of the start sweep subroutine of the optimization program.

Next, referring to FIG. 9, subroutine startsweep is described in detail. The startsweep subroutine 9000 provides the initial values from the PLC program 7000 and processor 85. These values include the machine status, the actual plunge which has been taken at the beginning of the sweep, the tip ratio (a value that defines the cutter dullness), the status of the swing cylinder (i.e., from which swing cylinder data is received at the beginning of the sweep, thus allowing assessment of the direction in which the cutterhead is being swept), and the extension on that swing cylinder at the beginning of the sweep (which provides the angle of sweep).

Now referring to block 9002, "machine status 0", this block looks for a machine status word which tells the program to continue. The program will keep looping until that word is updated, and once it is updated, the program will proceed. In other words, if machine status equals 0, the program will loop back to block 9002. If machine status does not equal 0, the program will continue to block 9004.

Block 9004, "read words 2 through 5", reads words that include the actual plunge at the beginning of the swing, the tip ratio for the cutters (defines the dullness of the cutters), which extension cylinder the data is coming from (defines in which direction the cutterhead is going to swing), and what the extension of that particular cylinder was (defines the position of the cutterhead at the beginning of the swing).

Next referring to block 9006, "calculate swing", at this block the actual position of the cutterhead in terms of its angle with respect to the tunnel axis is calculated from the swing cylinder extension which was inputted in the previous block 9004. Two equations are included, one for the left cylinder and one for the right cylinder:

$$LL = \cos^{-1}\left(\frac{1.875 - (CY + 1284)^2}{}\right) - 1.365$$

$$RR = 1.365 - \cos^{-1}\left(\frac{1.875 - (CY + 1284)^2}{7238322}\right)$$

where $CY$ = cylinder extension in mm

Referring next to block 9008, "clear words", all BTR words are reset to 0. The words are now ready for new transmission from the PLC program 7000 and processor 85. Words 1 through 7 are defined as follows: word 1 is the status of the machine—e.g., inactive, slewing, ramping down; word 2 describes the true plunge of the machine at the beginning of each swing; word 3 defines the cutter tip ratio; word 4 describes which swing extension cylinder the swing data is coming from; word 5 is the actual extension of that particular swing cylinder in millimeters; word 6 is the time between transmissions which is used to calculate the swing rate; word 7 is the cutterhead motor amperage. Additionally, a word 8, defining the actual normal loads on the cutters, may be employed.

Referring next to block 9010, "return to main program", at this block the startsweep subroutine 9000 is completed and the program is returned to main program 8000.

Figure 10:
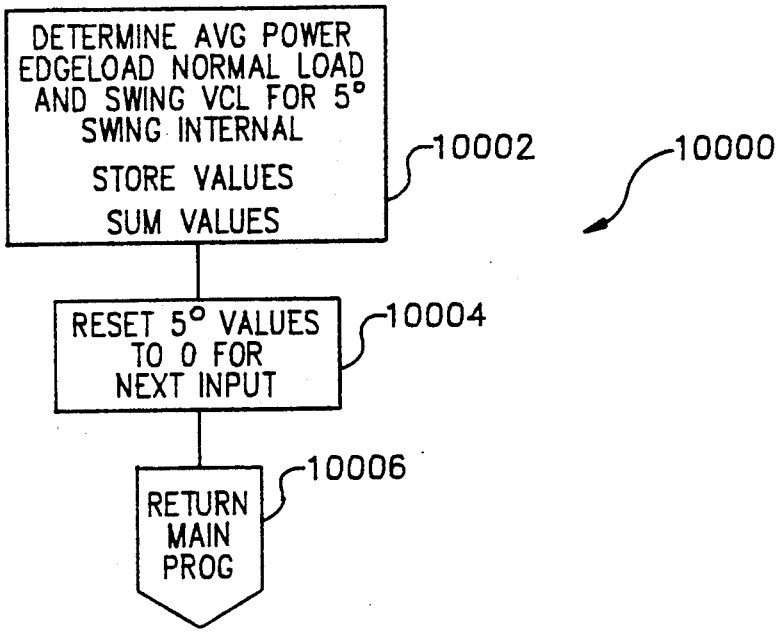
FIG. 10 is a flow chart of the matrix subroutine of the optimization program.

Next referring to subroutine matrix 10000 as shown in FIG. 10, subroutine 10000 performs as follows. As the cutterhead is slewing, matrix subroutine 10000 puts into a matrix the average cutterhead power, cutter normal load, cutter edge load and slew velocity for every 5° of swing. The 5° interval is not fixed, and can be changed.

First referring to block 10002, "calculate averages", at this block the average values for cutterhead power, cutter normal load, cutter edge load, the slew velocity that occurred within each 5° swing interval are calculated. In addition to calculating the average value, summations of the average values are made. These summations will eventually be used to calculate the average cutterhead power, cutter normal load, cutter edge load, and slew velocity for the entire swing.

At block 10004, "reset averages", the sums and count for the 5° averages are reset to 0 so that the next set of data can be entered.

Block 10006, "return to main program", ends subroutine matrix 10000 and returns the program to optimization program 8000, as described above.

Figure 11:
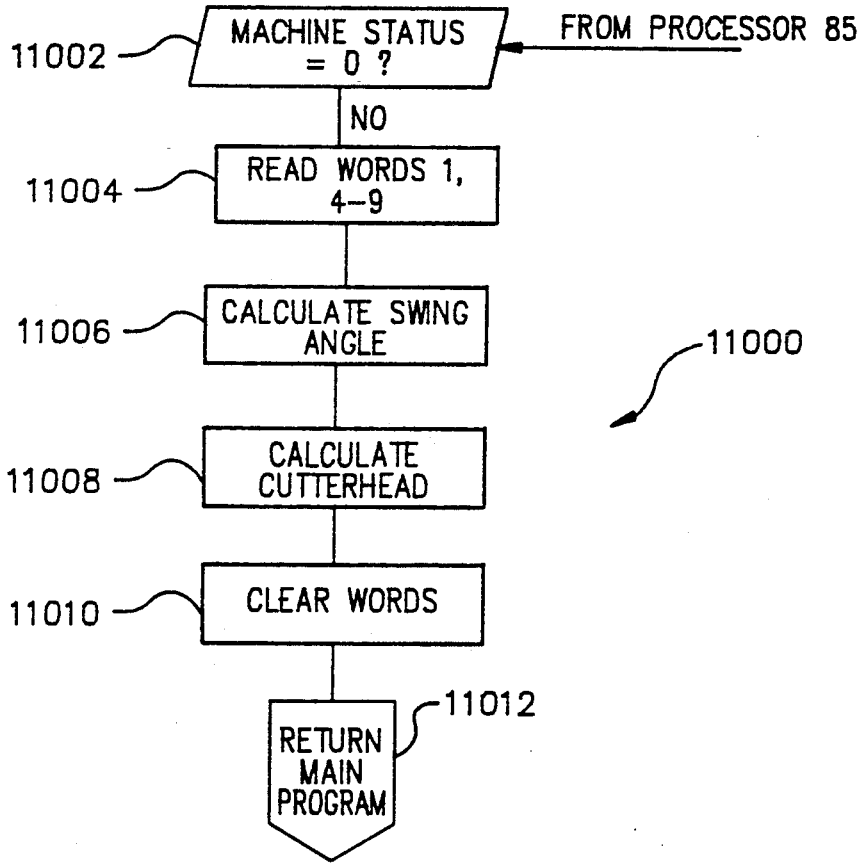
FIG. 11 is a flow chart of the machine dat subroutine of the optimization program.

Referring now to subroutine machinedat 11000 of FIG. 11, this subroutine reads words (i.e., data) sent to the optimization module 87 by the processor 85 and PLC program 7000 while the machine slewing. These words include the machine status, which swing extension cylinder is being operated, the actual cylinder extension, how much time has elapsed between transmissions and the cutter motor amperage. If data is also being collected from instrument cutters and true cutter normal loads are being monitored, this data can also be passed as word 8.

Referring first to block 11002, "machine status 0", if the machine status word is 0 (i.e., machine is not operating or no data is available), the program keeps looping until the status word is changed to 1 or some other value. Referring now to block 11004, "read words 4 through 7", at this block the program reads the following words: word 4, which defines the swing extension cylinder that extension data is coming from: word 5, which gives the actual extension of the cylinder; word 6, which gives the time that has elapsed between transmission of data; and word 7, which gives the cutterhead motor amperage. Again, a word 8 will be added if true cutter normal load data is collected. Additional words for other input data can also be added.

Referring next to block 11006, "calculate swing angle", at this block the cylinder extension data is converted to the swing angle (i.e., the position of the cutterhead at the face). The equations for this calculation are the same as those employed in calculating the position of the angle of the cutterhead when it is at the wall. In other words, the equations are the same as the equations for the left and right cylinder positions referred to in block 9006 of the startsweep subroutine 9000.

Next referring to block 11008, "calculate cutterhead power", at this block the actual operating cutterhead power is calculated from amperage data. This is done using an equation based on the motor power curve. The equation can be derived using curve fitting techniques.

Referring next to block 11010, "clear words" at block 11010, all BTR words are reset to 0 after the data has been collected.

At block 11012, "return to main program", the program exits subroutine machinedat 11000 and returns to optimization program 8000.

Figure 12A:
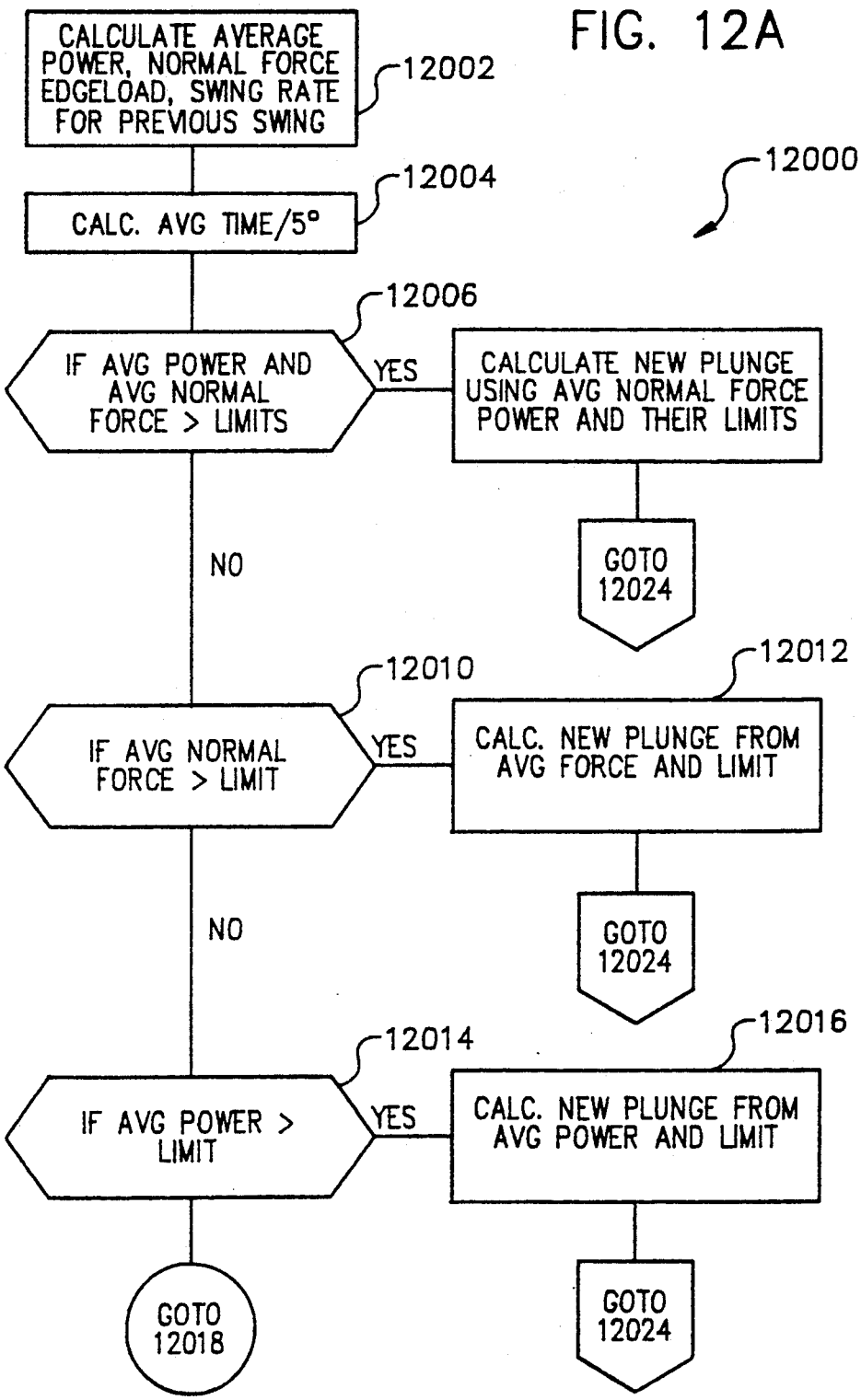
FIGS. 12A–12B is a flow chart of the ramp subroutine of the optimization program.
Figure 12B:
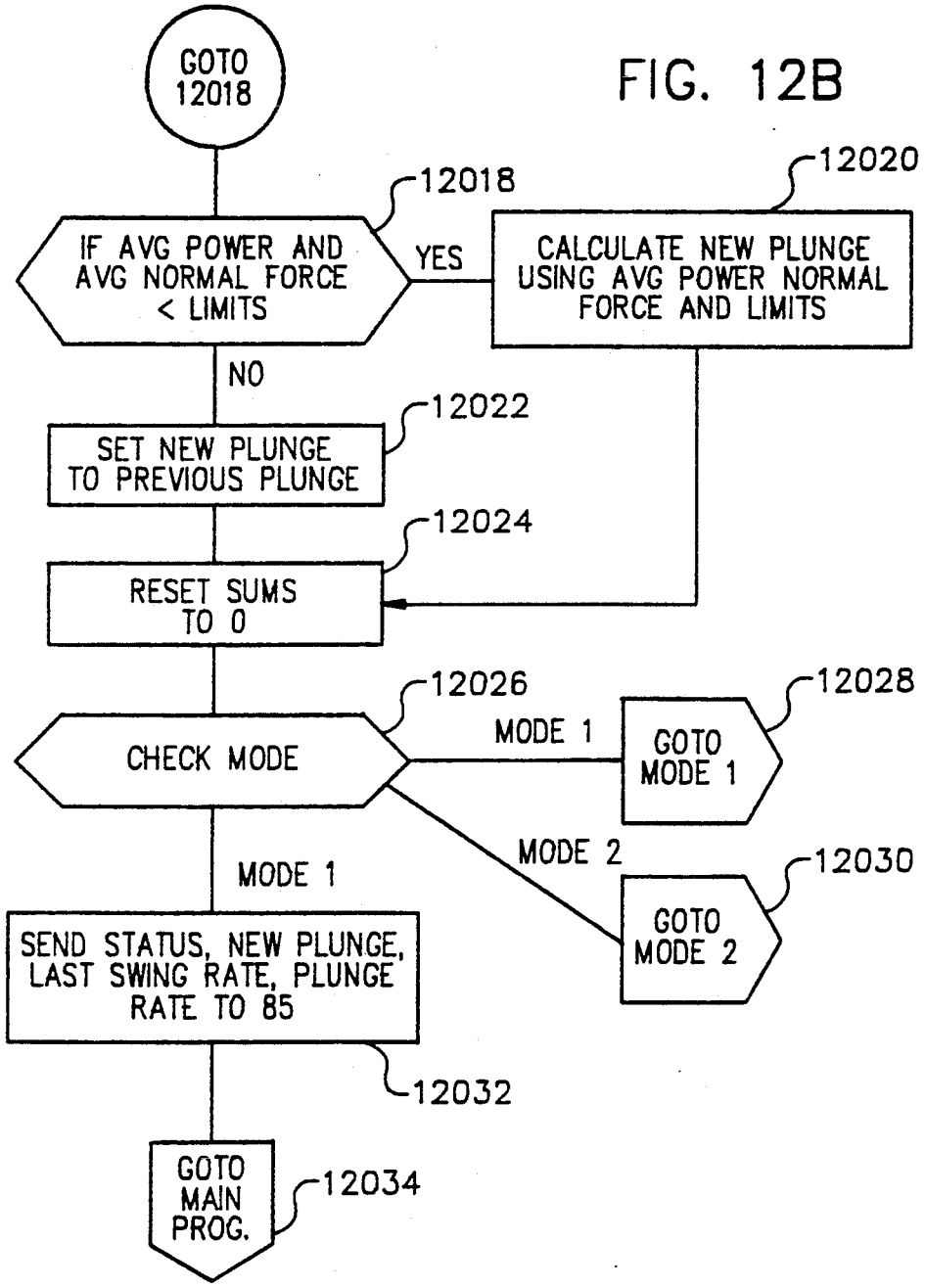

Referring next to subroutine ramp 12000 of FIGS. 12A-12B, subroutine ramp 12000 is positioned on a subroutine machinedat 11000 and is called if the mobile mining machine is ramping down. Subroutine ramp 12000 is used to calculate the average cutterhead power, cutter edge load, cutter normal load, and swing load for the previous swing. Subroutine ramp 12000 then evaluates these values and determines their relationship to the limits which have been set for them. If any of the limits are exceeded, downward adjustments are made to the previous plunge and slew velocity. Similarly, if any of the limits are not reached, upward adjustments are made to the previous plunge and the slew velocity.

Referring to block 12002, "calculate averages", at this block the average values for cutter edge load, cutterhead power, cutter normal force, and slew velocity are calculated from the average 5° values stored in the matrices.

Referring next to block 12004, "calculate average time", the average time that was required for a 5° swing is calculated.

Referring next to block 12006, this block is a decision block in which the average cutterhead power, cutter edge load, cutter normal load and slew velocity are first calculated. These are the average values for the entire swing and are calculated from the numbers that were stored in the 5° matrix. In block 12000, the values for cutterhead power and cutter normal load are checked against their limits, and a new plunge value is calculated for the next swing if the average values are above or below the limits. For example, if the limits for average normal force and average cutterhead power are both exceeded, the program proceeds to block 12008 in which a new plunge value is calculated based on ratios between the average normal force and the limiting force, and the average cutterhead power and the limiting power. The corrections to plunge values used are based on the relationships between cutter penetration and cutter normal force, and between cutter rolling force (proportional to power), and cutter penetration as derived from the published predictor equations contained in the Annual Report: Mechanical Tunnel Boring Predictions and Machine Design, L. Ozdemir, et. al., Colorado School of Mines (1973). The corrections used are:

$$\text{New plunge} = \text{old plunge} \times \left(\frac{\text{cutter normal force limit}}{\text{observed cutter normal force}}\right)^2 \quad \text{(Eq. 1)}$$

$$\text{New plunge} = \text{old plunge} \times \left(\frac{\text{power limit}}{\text{observed cutterhead power}}\right) \quad \text{(Eq. 2)}$$

The above equations, as well as Equations 3-8 below, can be employed by those skilled in the art. In addition, field performance test data can be used to derive precise relationships (which may vary with rock conditions). The calculated plunge value, which is the lesser of Eq. 1 and Eq. 2 will be chosen for the next sweep. The program proceeds from block 12008 to block 12024 described in further detail below.

Referring back to decision block 12006, if the decision is "no", the program proceeds from block 12006 to block 12010 where it is determined if the average cutter normal force has exceeded its limit. If the decision is "yes", then the average cutter normal force is higher than its limit, but the average cutterhead power is not.

At that point, the program proceeds to block 12012 in which a new plunge value is calculated based on the average cutter normal force and the normal force limit (Eq. 1). From block 12012, the program will then proceed to block 12024 to be described in further detail below. Referring back to decision block 12012, if the decision is "no", in other words, if the limiting cutter normal force is not exceeded, the program proceeds to block 12014 in which a check is made to see if the average cutterhead power has exceeded its limit. If the average power has exceeded its limit but average normal force has not, the program proceeds to block 12016.

In block 12016, a new plunge is calculated from the average cutterhead power and power limit (Eq. 1). Next, from block 12016, the program proceeds to block 12024 to be described in further detail below.

Referring back to block 12014, if neither the power limit nor the cutter normal force limit is exceeded, the program checks at block 12018 to see if the average power and average cutter normal force are below a certain percent of their limits. The actual percentages employed are to be based on field performance data.

If both the average cutter normal force and cutterhead power are below the limits, an adjustment is made to the plunge, i.e., the plunge must be increased in order to bring either the normal force or cutterhead power up to its desired limit. This is done in block 12020. In block 12020, both a new plunge based on the average cutter normal force and a new plunge based on the average cutterhead power are calculated. The lesser of these two values is then chosen.

From block 12020, the program proceeds to block 12024 to be explained in further detail below. Referring again to block 12018, if the average cutterhead power and the average cutter normal force do not exceed the limits or are not significantly below the limits, then, at block 12022, the plunge for the next swing is set to the plunge which was used in the previous swing.

Next referring to block 12024, in block 12024 the summation values used for calculation of averages are reset to 0.

Referring now to block 12026, the "check mode" block, if mode 1 has been selected, the program then proceeds, at block 12028, to mode 1 subroutine 13000. Similarly, if mode 2 has been selected, the program, at block 12030, goes to mode 2 subroutine 14000. However, if mode 3 has been selected, then the program at blocks 12032 and 12034 sends to the PLC program 7000 and processor 85 the new calculated plunge and the average slew rate from the previous swing. The program then returns to the optimization program 8000 at block 8016.

Figure 13:
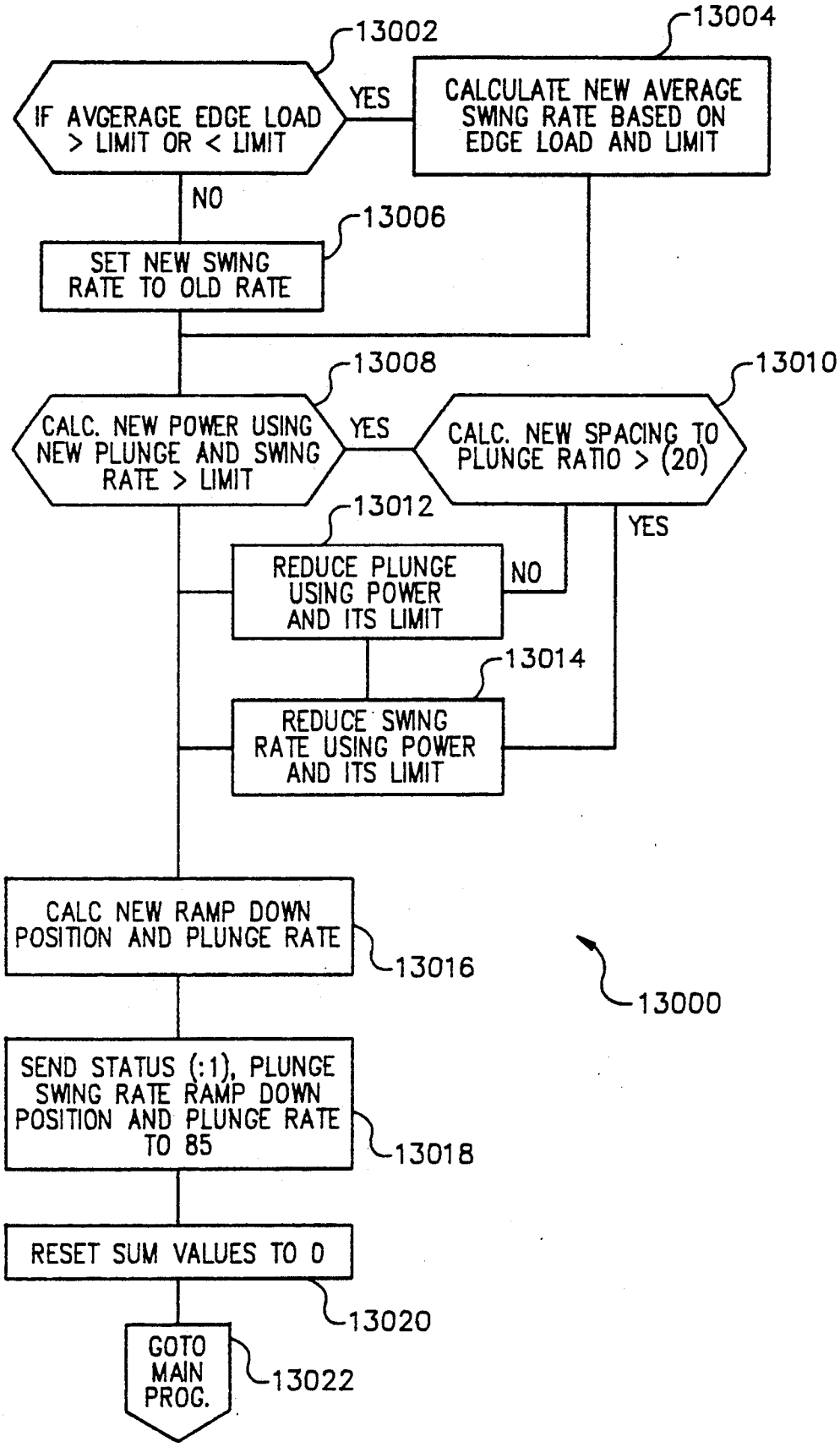
FIG. 13 is a flow chart of the mode 1 subroutine of the optimization program.

Referring to mode 1 subroutine of FIG. 13, the mode 1 subroutine 13000 calculates the new average slew rate for the next swing and sends it to the PLC program 7000 and processor 85.

Referring first to block 13002, the average cutter edge load for the previous swing is compared with the limit value for the cutter-edge load. It is then determined if the average cutter edge load is either greater than or less than the limiting value. It is to be noted that block 13002 is a decision block, and if the answer is "yes", the program proceeds to block 13004. At block 13004, a new slew velocity load is calculated based on the average cutter edge load and the cutter edge load limit. This calculation is based on the relationship between cutter normal force and cutter spacing as found in the above referenced Colorado School of Mines (CSM) publication (note, cutter edge load is proportional to normal load at constant penetration):

$$\text{New slew rate} = \text{old slew rate} \times \left(\frac{\text{observed edge load}}{\text{edge load limit}}\right) \quad \text{(Eq. 3)}$$

From block 13004 the program proceeds to block 13008 to be described in detail below. Referring again to block 13002, a decision block, if the answer is "no" the program proceeds to block 13006. In block 13006, the new slew rate is set to the slew rate which was used in the previous swing. From block 13006, the program proceeds to block 13008, a decision block at which the calculation of the new power requirements based on the new plunge and the new slew rate is made. This calculation is based on the relationships between cutter rolling force, cutter penetration and cutter spacing as found in the above referenced Colorado School of Mines publication:

$$\text{New power} = \text{old power} \times \left(\frac{\text{new plunge}}{\text{old plunge}}\right) \times \left(\frac{\text{new swing rate}}{\text{old swing rate}}\right) \quad \text{(Eq. 4)}$$

The new power is then compared with the power limit and it is determined if the new power exceeds that limit. If the answer is "yes", the program proceeds to block 13010. At block 13010 it is then determined if the new spacing between cutter paths (as calculated from the slew velocity) divided by the new plunge is greater than some limiting value. Initially this value will be 20 but can be changed based on field test data. It is to be noted that block 13010 is a decision block, and if the answer is "no", the program proceeds to block 13012. In block 13012, an adjustment is made to the new plunge. This adjustment is based on the relationship between cutter rolling force (directly proportional to power) and penetration as found in the above referenced Colorado School of Mines publication:

$$\text{Adjusted plunge} = \text{new plunge} \times \left(\frac{\text{power limit}}{\text{power calculated}}\right) \quad \text{(Eq. 5)}$$

This adjustment is made whenever the spacing to penetration ratio is less than the limiting value, for example, 20. From block 13012, the program then proceeds to block 13016 to be described in further detail below. Referring back to block 13010, a decision block, if the answer is "yes" the program proceeds to block 13014. In block 13014, an adjustment is made to the slew rate. This occurs whenever the spacing to penetration ratio is greater than 20. This adjustment is based on the relationship between cutter rolling force (proportional to power) and cutter spacing as found in the above referenced Colorado School of Mines publication:

$$\text{Adjusted slew rate} = \text{new slew rate} \times \left(\frac{\text{calc power}}{\text{power limit}}\right)^2 \quad \text{(Eq. 6)}$$

After block 13014, the program proceeds to block 13016 to be described in detail below. Referring back to decision block 13018, if the answer is "no", the program proceeds to block 13016. At block 13016, a calculation is made to determine at what swing cylinder extension the machine should ramp down during the next swing. Next, the program proceeds to block 13018. At block 13018, a plunge rate is calculated and the new plunge, new slew rate, cylinder extension at ramp down, and plunge rate are sent to the PLC program 7000 and processor 85 in block 13018. The program next proceeds to block 13020. At block 13020, the variables which represent the summations used in calculating the averages are reset to 0. Finally, at block 13022, mode 1 subroutine 13000 returns the program to the optimization program 8000 at block 8016.

Figure 14:
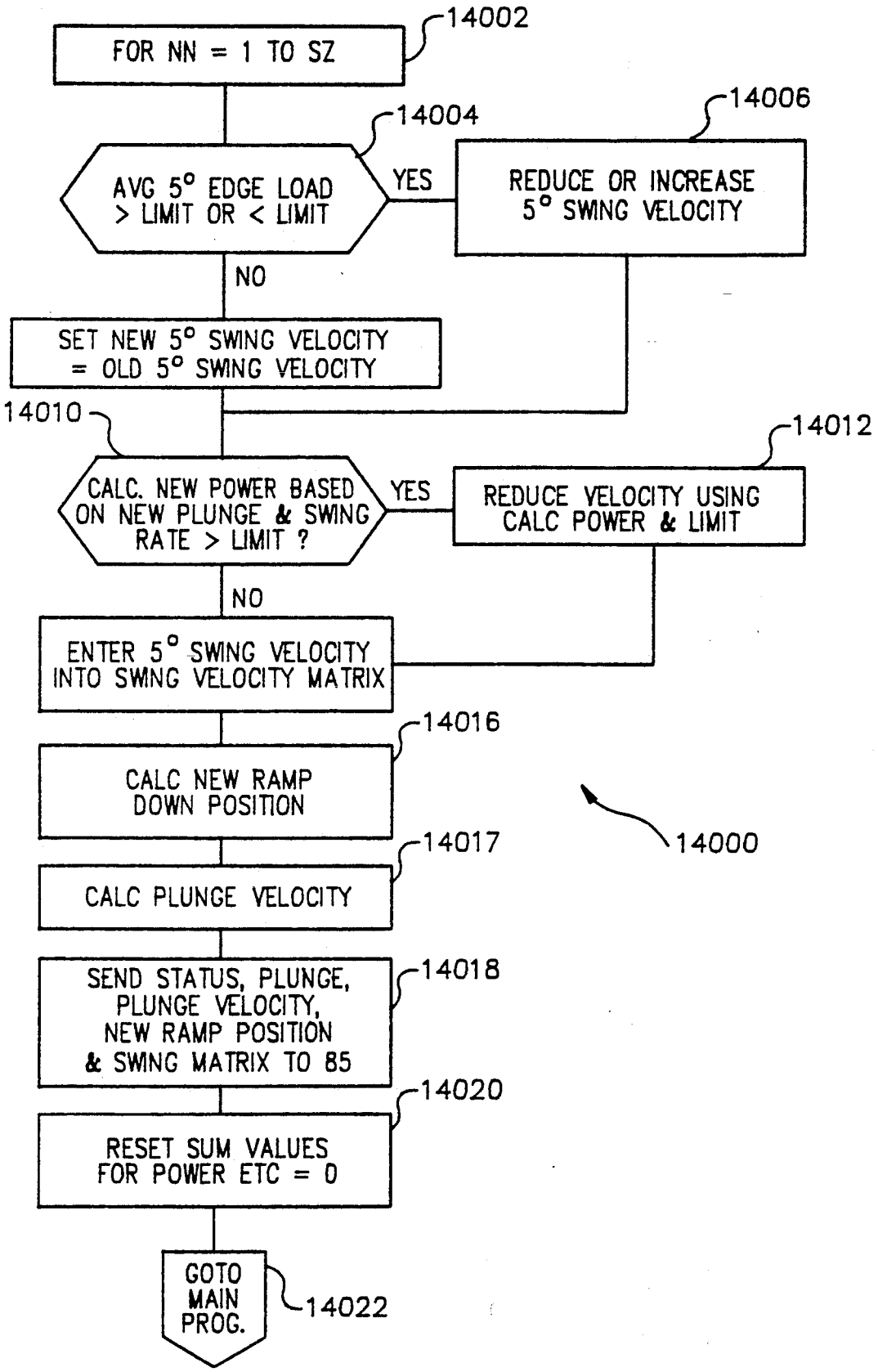
FIG. 14 is a flow chart of the mode 2 subroutine of the optimization program.

Next referring to mode 2 subroutine 14000 of FIG. 14, a slew rate matrix rather than an average slew rate is calculated for the next swing. The slew rate matrix will be divided into partitions such as 5° or 10° of slew. The actual partition size is a value to be determined based on actual operating conditions. First, referring to block 14002, this block is the beginning of a "do-loop" that checks the average performance values contained in the performance data matrices.

Referring next to block 14004, block 14004 is a decision block at which the value of the average cutter edge load at each swing position is compared with the cutter edge load limit. It is determined if average cutter edge load exceeds the limit or is below the limit. If the answer at block 14004 is "yes", the program proceeds to block 14006, at which a new slew rate is determined based on the cutter edge load limit and the actual cutter edge load in that position of swing. This adjustment is based on the relationship between the cutter normal force and cutter spacing as found in Eq. 3 above. From block 14006 the program proceeds to block 14010 to be described in detail below.

Again referring to block 14004, a decision block, if the answer is "no", the program proceeds to block 14008. At block 14008, the new slew rate is set to the previous slew rate for the same swing angle position.

From block 14008, the program then proceeds to block 14010. In block 14010, a check of the power requirements based on the new slew rate and the new plunge will be made using Eq. 4 above. It will be determined if the new power is above the power limit. It will be noted that block 14010 is a decision block; if the answer is "yes", the program proceeds to block 14012.

In block 14012, because an overload cutterhead power has been determined, the slew rate must be reduced to bring the cutterhead power below its limit using Eq. 6 above. From block 14012, the program proceeds to block 14014 to be described in further detail below.

Again referring to decision block 14010, if the answer is "no", the program then proceeds to block 14014. Block 14014 is the end of the "do-loop" and the program then checks the performance data in the matrices at the next swing position. In other words, the program then loops back to block 14002. It should be noted that this do-loop is terminated when the matrix size (52) is reached in block 14002. When 52 is reached, the program then proceeds to block 14014. At block 14014, the calculated slew velocity is entered into the swing velocity matrix.

In block 14016, a calculation of the position of the cylinder extension for the next ramp down is made, and at 14017, a new plunge rate is calculated.

Next, the program goes to block 14018. At 14018, the new values of the plunge, plunge rate, slew rate, and new ramp down position are transferred to the PLC program 7000 and processor 85. At block 14020, the main variables which represent the summations for cutterhead power, cutter edge load, cutter normal force, and slew rate are reset to 0. Finally, at block 14022, the subroutine sends the program back to optimization program 8000, specifically to block 8016.

Figure 15:
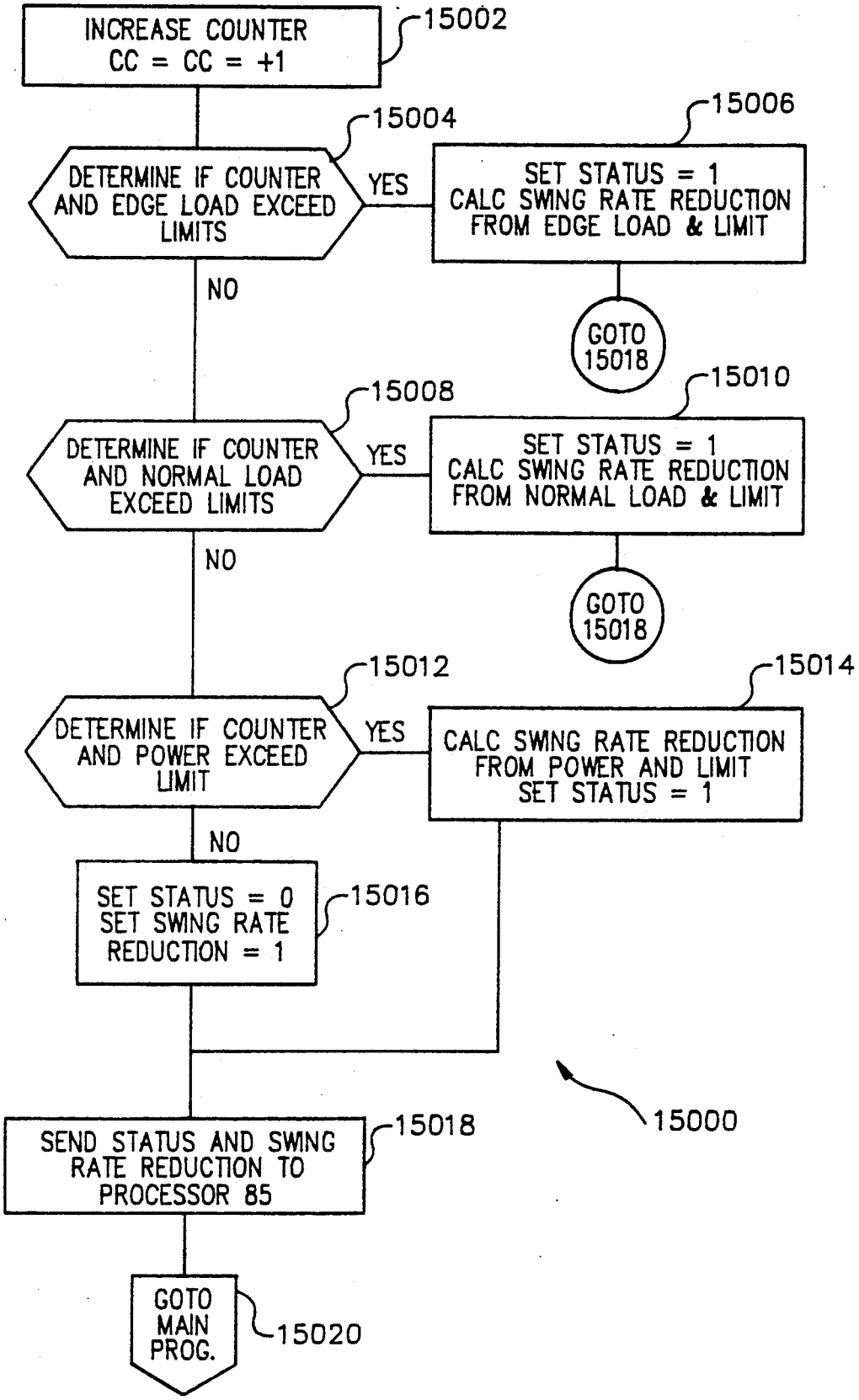
FIG. 15 is a flow chart of the mode 3 reduce subroutine of the optimization program.

Referring next to mode 3 reduce subroutine 15000 of FIG. 15, this subroutine reduces the slew rate if an overload occurs in either the cutterhead power, the cutter edge load or the cutter normal load during a swing.

Block 15002 increments a counter that is used to determines how long the overload has occurred. Block 15004 is a decision block in which it is determined whether an overload has occurred for the average cutter edge load for a specified count. Criteria will be set for both the amount of overload and count to be tolerated based on field test data. If the answer to decision block 15004 is "yes", the program proceeds to block 15006.

In block 15006, a reduction in the slew rate is determined based on the ratio between cutter edge load limit and the observed cutter edge load value (see Eq. 3). From block 15006, the program then proceeds to block 15018 to be described in detail below.

Again referring to block 15004, if the answer to the decision is "no", the program proceeds to block 15008. Block 15008 is a decision block in which it is determined if the cutter normal load limit has been exceeded for a specified count. Again, criteria for both the overload and count will be based on field test data.

If the answer to the decision in block 15008 is "yes". the program proceeds to block 15010 at which a reduction in swing rate is calculated using the ratio between the cutter normal load limit and the cutter normal load. This ratio is based on the relationship between cutter spacing and cutter normal load as found in the above referenced Colorado School of Mines publication:

$$\text{New slew rate} = \text{old slew rate} \times \left(\frac{\text{observed normal load}}{\text{normal load limit}}\right) \quad \text{(Eq. 7)}$$

From block 15010, the program proceeds to block 15018, again to be described in further detail below.

Referring again to block 15008, if the answer to the decision is "no", the program proceeds to block 15012, another decision block. In block 15012, the cutterhead power is examined and it is determined if the cutterhead power has exceeded its limit for a specified count. If the answer at block 15012 is "yes", the program proceeds to block 15014.

At block 15014, an adjustment is made to the slew rate based on the ratio between the observed cutterhead power and the limiting power. This ratio is based on the relationship between the cutter normal load (proportional to edge load and power at a fixed penetration) and cutter spacing as found in the above referenced Colorado School of Mines publication.

$$\text{New slew rate} - \text{old slew rate} \times \left(\frac{\text{observed power}}{\text{power limit}}\right) \quad \text{(Eq. 8)}$$

From block 15014, the program then proceeds to block 15018 to be described in detail below.

Referring back to decision block 15012, if the answer is "no", the program then proceeds to block 15016. In block 15016, the status of the optimization module is set to 0 and the correction factor for the slew rate is set to 1 (i.e., no slew rate correction made).

From block 15016, the program then goes to block 15018 in which the status and the new slew rate correction is then sent to the PLC program 7000 and processor 85. From block 15018, the program proceeds, at block 15020, to block 8016 of optimization program 8000.

Figure 16:
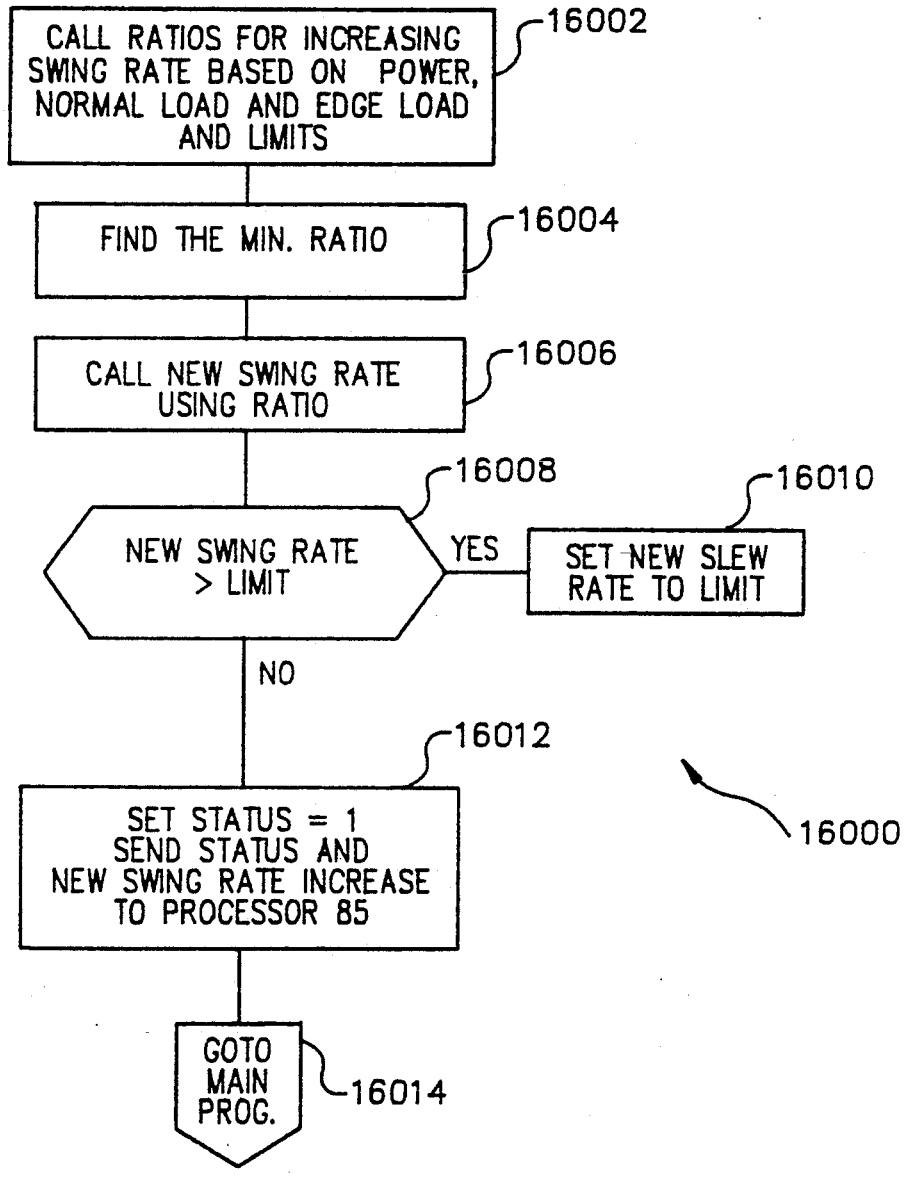
FIG. 16 is a flow chart of the mode 3 increase subroutine of the optimization program.

Next referring to mode 3 increase subroutine 16000 of FIG. 16, this subroutine is used if it is determined that the cutterhead power, the cutter normal load and the cutter edge load are all below their limits. At that point, an increase in the swing rate can take place.

First referring to block 16002, calculations of the ratios that are used to increase the swing rate are made. These ratios are a function of the observed power versus the power limit, the observed cutter edge load versus the cutter edge load limit, and the observed cutter normal load versus the normal load limit (see Eq. 3, 6 and 8).

Next referring to block 16004, it is determined which of the three ratios calculated in block 16002 is the minimal ratio. That minimal ratio is the one which will be used to modify the slew rate.

At block 16006, the slewing rate is modified by the minimal ratio.

Block 16008 is a decision block in which it is determined if the new modified slew rate exceeds the limiting slew rate. If the answer to this decision is "yes", the program proceeds to block 16010 where the slew rate is set back to the limiting value. From block 16010, the program proceeds to block 16012 to be described in detail below.

Referring back to block 16008, a decision block, if the answer is "no", the program then proceeds to block 16012. In block 16012, the new slew rate value or the correction which will be used to increase or reduce the slew rate, is then sent to the PLC program 7000 and processor 85. Finally, the program goes to block 16014 where the program is returned to optimization program 8000 at block 8016.

It will, of course, be realized that while the above has been given by way of illustrative example of this invention, all such and other modifications and variations thereto as would be apparent to persons skilled in the art are deemed to fall within the broad scope and ambit of this invention as is herein set forth.

We claim:

1. A method of controlling a mobile mining machine of the type having a cutting wheel rotatable about a horizontal axis by wheel drive means and traversable across a mining face in order to maximize its mined output including selectively controlling the kerf depth and kerf spacing such that the kerf ratio of kerf depth to kerf spacing approaches the optimum value for the rock being cut by continuously monitoring a sensing mining machine parameter and altering one or more of cutter penetration depth, cutter penetration rate, cutting wheel speed, and cutter slew rate based on one or more of a predetermined optimum cutter penetration depth value, a predetermined optimum cutter penetration rate value, a predetermined optimum cutting wheel speed value and a predetermined optimum cutter slew rate value derived from said sensed mining machine parameter.

2. Apparatus for automatically controlling one or more of cutter penetration depth, cutter penetration rate, and the cutter slew rate of a mining machine which includes a rotatable cutterhead having cutters and a boom assembly causing slewing of the cutterhead and a plunge assembly causing plunging of the cutterhead relative to the mining machine, said apparatus comprising:

means for sensing a given mining machine parameter;

means for processing said mining machine parameter to derive one or more of an optimum cutter penetration depth value, an optimum cutter penetration rate value, and an optimum cutter slew rate value;

controlling means for controlling one or more of cutter penetration depth, cutter penetration rate, and cutter slew rate based on one or more of said optimum cutter penetration depth value, on, said optimum cutter penetration rate value, and said optimum cutter slew rate value.

3. The apparatus of claim 2 wherein said optimum cutter slew rate value is based on said mining machine parameters from a previous entire slew and is employed during a current entire slew by said controlling means.

4. The apparatus of claim 2 wherein said optimum cutter slew rate value is a plurality of incremental values based on said mining machine parameters from increments of a prior slew, and one of said increments of said optimum cutter slew rate value is employed by said controlling means during each increment of a current slew that corresponds to an increment of the prior slew.

5. The apparatus of claim 2 wherein said optimum cutter slew rate value is a plurality of incremental values based on said mining machine parameters from prior increments of a current slew, and said optimum cutter slew rate value is employed during the next increment of the current slew by said controlling means.

6. The apparatus of claim 2 wherein said optimum cutter penetration rate value and said optimum cutter penetration depth value are based on said mining machine parameters from a previous plunge and are employed during a current plunge by said controlling means.

7. The apparatus of claim 2 wherein said means for sensing a given mining machine parameter comprises:

means for sensing boom swing position.

8. The apparatus of claim 2 wherein means for sensing a given mining machine parameter comprises:

means for sensing beam position.

9. The apparatus of claim 2 wherein said means for sensing a given mining machine parameter comprises:

means for sensing boom force.

10. The apparatus of claim 2 wherein said means for sensing a given mining machine parameter comprises:

sensor means for sensing swing cylinder force.

11. The apparatus of claim 2 wherein said means for sensing a given mining machine parameter comprises:

means for sensing cutterhead motor amperage.

12. The apparatus of claim 2 wherein said means for sensing a given mining machine parameter comprises:

means for sensing cutter force at a cutter.

13. The apparatus of claim 2 wherein said means for processing said mining machine parameter derives said optimum cutter penetration value and said optimum cutter slew rate value based on average cutter normal force, cutter edge load and cutter head drive power.

14. The apparatus of claim 13 wherein said means for processing said mining machine parameter derives said average cutter normal force from average tangential force on the cutters and from average cutter coefficient.

15. The apparatus of claim 14 wherein said means for processing said mining machine parameter derives said average tangential force on the cutters from cutterhead torque, derives said average cutter coefficient from cutter penetration, derives said cutterhead torque from motor amperage, derives cutter penetration from plunge and slew angle, and derives slew angle from cylinder extension.

16. The apparatus of claim 13 wherein said means for processing said mining machine parameter derives said cutter edge load from tangential force on the cutters and cutter penetration.

17. The apparatus of claim 16 wherein said means for processing said mining machine parameter derives said tangential force on the cutters from cutterhead torque, derives cutterhead torque from motor amperage, derives cutter penetration from plunge and slew angle, and derives slew angle from cylinder extension.

18. A method for automatically controlling one or more cutter penetration depth, cutter penetration rate, and the cutter slew rate of a mining machine which includes a rotatable cutterhead having cutters, a boom assembly causing slewing of the cutterhead relative to the mining machine, a plunge assembly causing plunging of the cutterhead relative to the mining machine, sensing means, processing means, and controlling means, said method comprising the steps of:

sensing a given mining machine parameter with said sensing means;

processing said given mining machine parameter with said processing means to derive one or more of an optimum cutter penetration depth value, an optimum cutter penetration rate valve, and an optimum cutter slew rate value; and controlling one or more of cutter penetration depth, cutter penetration rate, and cutter slew rate with said controlling means based on one or more of said optimum cutter penetration depth value, said optimum cutter penetration rate value, and on said slew rate value.

19. A method of controlling a mobile mining machine of the type having a cutting wheel rotatable about a horizontal axis by wheel drive means and traversable across a mining face by slewing means in order to maximize its mined output consistent with maintaining cutting power near a desired limit, including selectively controlling the kerf depth and kerf spacing such that the kerf ratio of kerf depth to kerf spacing approaches a predetermined value for the rock being cut by continuously monitoring a measure of cutting power or force and altering the speed of the slewing means to vary the traversing speed and thus the kerf spacing wherein said measure of cutting power or force is the wheel drive means power input, and a feedback control system is utilized to maintain said wheel drive means power near a predetermined maximum level.

20. A method of controlling a mobile mining machine as claimed in claim 19, further including providing force-measurement transducers for monitoring selected forces applied to said cutting wheel by the cutting process and utilizing the output from said force-measurement transducers to said feedback control for reducing the speed of said slewing means as required to maintain said selected forces below predetermined limits.

21. A method of controlling a mobile mining machine of the type having a cutting wheel rotatable about a horizontal axis by wheel drive means and traversable across a mining face by slewing means in order to maximize its mined output consistent with maintaining cutter wheel power near a desired limit, including selectively controlling the kerf depth and kerf spacing such that the kerf ratio of kerf depth to kerf spacing approaches a predetermined value for the rock being cut by continuously monitoring a measure of cutting power or force and altering the speed of the slewing means to vary the traversing speed and thus the kerf spacing and further including the monitoring of changes in rock properties transversely across a rock face by storing kerf-spacing information for a traverse of said cutting wheel and utilizing said kerf-spacing information to control the kerf spacing during successive traverses.

* * * * *